US010588828B2

(12) United States Patent
Gibbons et al.

(10) Patent No.: US 10,588,828 B2
(45) Date of Patent: Mar. 17, 2020

(54) TEETHING SCARF

(71) Applicant: The Boppy Company, LLC, Golden, CO (US)

(72) Inventors: Haley Gibbons, Westminster, CO (US); Jessica Gladstone, Golden, CO (US)

(73) Assignee: The Boppy Company, LLC, Golden, CO (US)

( * ) Notice: Subject to any disclaimer, the term of this patent is extended or adjusted under 35 U.S.C. 154(b) by 0 days.

(21) Appl. No.: 15/879,242

(22) Filed: Jan. 24, 2018

(65) Prior Publication Data

US 2018/0263857 A1 Sep. 20, 2018

Related U.S. Application Data

(60) Provisional application No. 62/471,812, filed on Mar. 15, 2017.

(51) Int. Cl.

| | |
|---|---|
| ***A61J 17/00*** | (2006.01) |
| ***A61J 17/02*** | (2006.01) |
| ***A41D 23/00*** | (2006.01) |
| ***A41D 1/21*** | (2018.01) |
| ***A41D 1/215*** | (2018.01) |

(52) U.S. Cl.

CPC ..... *A61J 17/02* (2013.01); *A41D 1/21* (2018.01); *A41D 1/215* (2018.01); *A41D 23/00* (2013.01)

(58) Field of Classification Search

CPC ..... A61J 17/02; A41D 1/21; A41D 1/215; A41D 2023/004; A41D 2023/008; A47D 13/02; A47D 23/00

See application file for complete search history.

(56) References Cited

U.S. PATENT DOCUMENTS

| | | | | |
|---|---|---|---|---|
| 4,694,510 | A | 9/1987 | Kamrath | |
| 6,209,133 | B1 | 4/2001 | Hinshaw | |
| D444,617 | S | 7/2001 | Dunn et al. | |
| 7,987,519 | B1 | 8/2011 | Raso | |
| 2006/0026729 | A1 | 2/2006 | Rothschild | |
| 2006/0237493 | A1* | 10/2006 | Tsai | A47D 13/025 224/159 |
| 2012/0117707 | A1 | 5/2012 | Gay | |
| 2013/0168422 | A1* | 7/2013 | Carbonell | A41D 1/215 224/158 |
| 2014/0027167 | A1 | 1/2014 | Kim et al. | |

(Continued)

FOREIGN PATENT DOCUMENTS

| | | | |
|---|---|---|---|
| DE | 8235005 | U1 | 5/1983 |
| DE | 10151444 | A1 | 5/2003 |

(Continued)

OTHER PUBLICATIONS

International Search Report and Written Opinion of PCT/US2018/016916 dated Apr. 25, 2018, all pages.

*Primary Examiner* — Erich G Herbermann

(74) *Attorney, Agent, or Firm* — Kilpatrick Townsend & Stockton LLP

(57) ABSTRACT

A teething scarf includes a fabric sheet having a length, a width, and a thickness, the width being greater than the thickness. The fabric sheet forms a continuous loop along the length. The teething scarf also includes a teething element coupled with the fabric sheet. The teething element includes a non-toxic material and being configured for use in easing pain associated with teething in infants.

15 Claims, 27 Drawing Sheets

(56) References Cited

U.S. PATENT DOCUMENTS

| | | | | |
|---|---|---|---|---|
| 2014/0151414 | A1 | 6/2014 | Gutierrez | |
| 2015/0189997 | A1* | 7/2015 | Gmeiner | A47D 13/02<br>224/158 |
| 2016/0144215 | A1* | 5/2016 | Schwandt | A41D 15/04<br>482/91 |

FOREIGN PATENT DOCUMENTS

| | | | |
|---|---|---|---|
| DE | 202006018425 | U1 | 3/2007 |
| WO | 2011028911 | A1 | 3/2011 |
| WO | 2014027167 | A2 | 2/2014 |

* cited by examiner

TEETHING SCARF

CROSS-REFERENCES TO RELATED APPLICATIONS

This Application claims priority to U.S. Provisional Patent Application No. 62/471,812, filed Mar. 15, 2017, entitled "TEETHING SCARF", the entire disclosure of which is hereby incorporated by reference, for all purposes, as if fully set forth herein.

BACKGROUND OF THE INVENTION

Babies usually begin teething around six months of age. Teething is the process by which a baby's primary teeth (i.e., first teeth) come in. This can be painful and uncomfortable as the teeth break through the skin causing soreness and swelling of the gums. During this process, some babies will bite and chew on objects to relieve pressure in their gums. To relieve some of the discomfort, caregivers may provide safe objects for babies to chew on. For example, some caregivers purchase teething toys for babies to bite and chew. Unfortunately, these products are easily lost and allow the baby's saliva to get on clothes and other objects.

BRIEF SUMMARY OF THE INVENTION

Embodiments of the invention include scarves that are configured to be worn in various arrangements on a user. The scarves include one or more teething members that are permanently or removably coupled to the scarves. These teething members are often positioned on the scarf such that when the scarf is worn and an infant is being held by the scarf wearer, the teething members are positioned at a level near the infant's mouth. In this way, a user is able to wear a fashionable scarf while also having the functionality of one or more teething members that may be used by an infant. Additionally, the teething members may be securely coupled with the scarf using techniques that prevent the infant from being able to uncouple the teething member. This ensures that the teething members are not dropped to the ground or otherwise exposed to unsanitary surfaces.

In one aspect, a teething scarf is provided. The teething scarf may include a fabric sheet having a length, a width, and a thickness. The width may be greater than the thickness. The fabric sheet may form a continuous loop along the length. The teething scarf may also include a teething element coupled with the fabric sheet. The teething element may include a non-toxic material and may be configured for use in easing pain associated with teething in infants. In some embodiments, the length may be at least 56 inches such that the continuous loop may be wrapped around a wearer's neck multiple times. In some embodiments, the fabric sheet comprises a first end and a second end. The first end and the second end may each be coupled with the teething element to form the continuous loop. In other embodiments, the fabric sheet may include a first end and a second end that are coupled with one another to form the continuous loop. In some embodiments, the teething element may include an annular member that is coupled with a first end and a second end of the fabric sheet. In some embodiments, the teething element may include a shank extending from a surface of the teething element. The shank may receive a portion of the fabric sheet. In some embodiments, the teething element may include an annular member that define a central opening. The central opening may receive a portion of the fabric sheet. In some embodiments, the teething element may include an annular member that defines a central opening and a strap that spans at least a portion of the central opening. The strip may include a fastener that secures the teething element at a position along the length of the fabric sheet. In some embodiments, the fabric sheet may be constructed from multiple pieces of fabric.

In another aspect, a teething scarf includes at least one fabric sheet having a length, a width, and a thickness, the width being greater than the thickness. Ends of the at least one fabric sheet may be coupled together such that the at least one fabric sheet forms a continuous loop along the length. The teething scarf may also include at least one teething element coupled with the at least one fabric sheet. The at least one teething element may include a non-toxic material and may be configured for use in easing pain associated with teething in infants. In some embodiments, the at least one fabric sheet may include a first fabric sheet and a second fabric sheet. The at least one teething element may include a first teething element and a second teething element. The first teething element may be coupled with a first end of the first fabric sheet and a first end of the second fabric sheet. The second teething element may be coupled with a second end of the first fabric sheet and a second end of the second fabric sheet. In some embodiments, the at least one teething element may be detachably coupled with the at least one fabric sheet. In some embodiments, the at least one fabric sheet may be slidingly engaged within an opening defined by the at least one teething element. In some embodiments, the at least one teething element may include a generally s-shaped member having a first end and a second end. In some embodiments, a first end of the at least one fabric sheet may be coupled with the first end of the generally s-shaped member and a second end of the at least one fabric sheet may be coupled with the second end of the generally s-shaped member. In some embodiments, the at least one teething element may include multiple interconnected annular members. In some embodiments, the at least one teething element may include a plurality of teething elements that each have a proximal end and a distal end. Each of the plurality of teething elements may be coupled with the at least one fabric sheet at the proximal end while the distal end remains detached from the at least one fabric sheet.

In another aspect, a method of using a teething scarf is provided. The method may include wrapping the teething scarf around a wearer's neck at least once such that the wearer's neck is positioned within a continuous loop formed by the teething scarf. The teething scarf may include a teething element that includes a non-toxic material and that may be configured for use in easing pain associated with teething in infants. The teething element may be positioned proximate the wearer's shoulder when the teething scarf is wrapped around the wearer's neck. The method may also include inserting the teething element into an infant's mouth while the teething scarf is wrapped around the wearer's neck. In some embodiments, the method may also include detaching the teething element by disengaging a fastener of the at least one fabric sheet to release the teething element. In other embodiments, the method may include detaching the teething element by disengaging a securement mechanism of the teething element from the at least one fabric sheet.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to scarves that include teething elements that may be chewed on by infants during the teething process. By coupling teething elements, such as teething rings and/or other teething devices, to a scarf, the wearer of the scarf can prevent an infant's teething element from dropping on the ground or being exposed to other unsanitary surfaces. Additionally, the teething elements may be positioned on the scarf such that when the scarf is being worn, the teething elements are positioned near the wearer's chest and/or shoulders such that they are in position to be chewed by an infant that is being held by the wearer. In some embodiments, the teething elements may be detachably coupled with the scarf in a manner that allows a user to remove the teething elements, so that the teething element may be cleaned and/or chilled. In such embodiments, the mechanisms for disengaging the teething element may be designed to be infant proof such that infants cannot remove the teething element from the scarf.

Figures 1A, 1B:
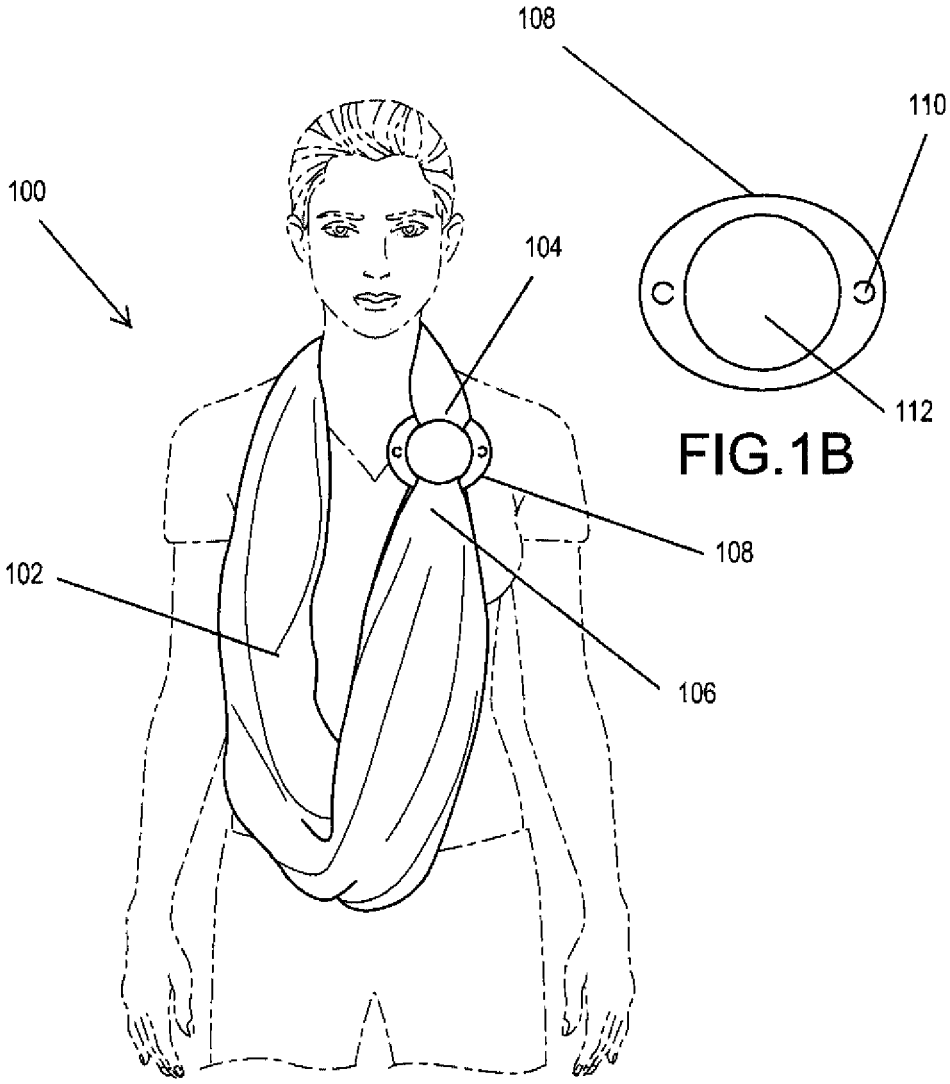
FIG. 1A depicts an embodiment of a teething scarf according to embodiments.
FIG. 1B is an annular teething element of the teething scarf of FIG. 1A according to embodiments.

Turning now to FIG. 1A, one embodiment of a teething scarf 100 is shown. Teething scarf 100 includes a fabric sheet 102 that has a length, a width, and a thickness. Typically, the width is greater than the thickness, oftentimes by a large amount such that the fabric sheet 102 is a generally flat piece of material. In some embodiments, the fabric sheet 102 has a length of at least 30-36 inches, commonly about 33 inches, allowing for the fabric sheet 102 to be wrapped about a wearer's neck in a single loop. In other embodiments, the fabric sheet 102 may have a length of at least 56 inches, commonly between about 56 and 75 inches. This allows the teething scarf 100 to be wrapped around a wearer's neck multiple times while not being too large and cumbersome. The scarf 100 may be made out of any number of fabrics (e.g., knits, lightweight wovens). These materials are durable enabling the teething scarf 100 to be washed and used repeatedly. The fabric sheet 102 may be formed from one or more individual pieces of material that are joined together, such as by stitching. In some embodiments, multiple fabric pieces may be joined end to end to form the length of fabric sheet 102. In other embodiments, multiple fabric pieces may be layered to form a multi-layered fabric sheet 102. Fabric sheet 102 may form a continuous loop along its length, such as by coupling a first end 104 with a second end 106. In some embodiments, the first end 104 and the second end 106 may be coupled directly to one another while in other embodiments, one or more intervening components may be used to secure the ends 104 and 106 with one another. In some embodiments, the looped fabric sheet 102 may be generally flat, with no twists in the fabric sheet 102, while in other embodiments the fabric sheet 102 may be twisted or braided along all or part of its length.

As shown here, first end 104 and second end 106 are coupled to one another via a teething element 108. The teething element 108 may be a teething ring or other teething device that is formed of a non-toxic material. For example, the teething element 108 may be made out of a soft chewable material such as rubber or plastic (e.g., food grade rubber or plastic). In some embodiments, the teething element 108 may be filled with a non-toxic liquid. These materials enable a baby to comfortably bite and chew with their gums, which may soothe and comfort the baby. It will be appreciated that other materials, such as non-toxic wood, metal, and/or other natural or synthetic materials may be used to form teething elements 108. Typically, the teething element 108 will have curved surfaces and/or rounded corners that are safe for infants. Because the baby is chewing and biting objects, the teething process is usually associated with excess saliva. This saliva may then be absorbed by the scarf 100 protecting the caregiver's clothes, the baby's clothes, and may also reduce or block formation of a rash on the baby's chin, face, and/or chest. As explained above, the teething scarf 100 may be sewn into a continuous loop or ring (e.g., infinity scarf). The teething scarf 100 may therefore be double wrapped (or more wraps) around a caregiver's neck for aesthetic reasons or to reposition the teething scarf 100.

As shown in FIG. 1B, teething element 108 is a teething ring having a generally elliptical shape (although other shapes may be contemplated) having a rounded cross-sectional profile (such as circular or elliptical). In some embodiments, teething element 108 may include one or more nubs 110 or detents that extend from (or into) an outer surface of the teething element 108. These nubs 110 may not only provide an additional aesthetic element to the teething scarf 100 but may also provide a textured surface for the infant to chew. In some embodiments, the teething element 108 may have a constant thickness, while in other embodiments, one or more of the sides of teething element 108 may have different thicknesses and/or widths. For example, as shown here, the sides are wider and/or thicker than the top and bottom of the teething element 108.

The teething element 108 is coupled with the first end 104 and the second end 106 of the fabric sheet 102 by having a portion of each end 104, 106 wrapped around a portion of the teething element 108. In some embodiments, a portion of the fabric sheet 102 may be threaded within a central opening 112 of the teething element 108, folded over another portion of the fabric sheet 102, and fastened (such as by using stitching, snaps, buttons, and the like) to itself to secure the teething element 108 onto the ends 104 and 106 of teething scarf 100. For example, a tip of one of the ends 104, 106 may be folded back and stitched or otherwise secured to a more medial portion of the fabric sheet 102 to form a small loop that may be used to secure the teething element 108. In some embodiments, such as where releasable fasteners like buttons and/or snaps are used to secure the fabric sheet 102 around the teething element 108, the releasable fasteners may be disengaged to allow the teething element 108 to be removed from the fabric sheet 102. This may be particularly useful as it allows the teething element 108 to be cleaned or chilled separately from the fabric sheet 102. It will be appreciated that in some embodiments, the teething element 108 itself may include a mechanism that allows the teething element 108 to be removed from the fabric sheet 102. For example, the teething element 108 may include a clasp or latch that can be disengaged and allows a portion of the teething element 108 to be pivoted, bent, and/or otherwise moved to open up the periphery of the teething element 108. This may allow the teething element 108 to be removed from the fabric sheet 102, such as by pulling a portion of the teething element 108 through a loop formed by an end 106, 108 of fabric sheet 102 being stitched to itself.

It will be appreciated that other techniques for securing the teething element 108 to the fabric sheet 102 may be contemplated. For example, the teething element 108 may be formed onto the fabric sheet 102. In other embodiments, an outer surface of the teething element 108 may define a recess, slot, or other opening that is configured to receive and secure end 106 and/or 108 of the fabric sheet 102.

In some embodiments, a width of the fabric sheet 102 may vary along its length. For example, the fabric sheet 102 may narrow toward the first end 104 and/or the second end 106. This provides less material near the teething element 108, which may be less wide that the fabric sheet 102. In other embodiments where the teething element 108 is narrower than the fabric sheet 102, the fabric sheet 102 may be at least partially folded to fit within the central opening 112 of the teething element 108.

Figures 2A, 2B:
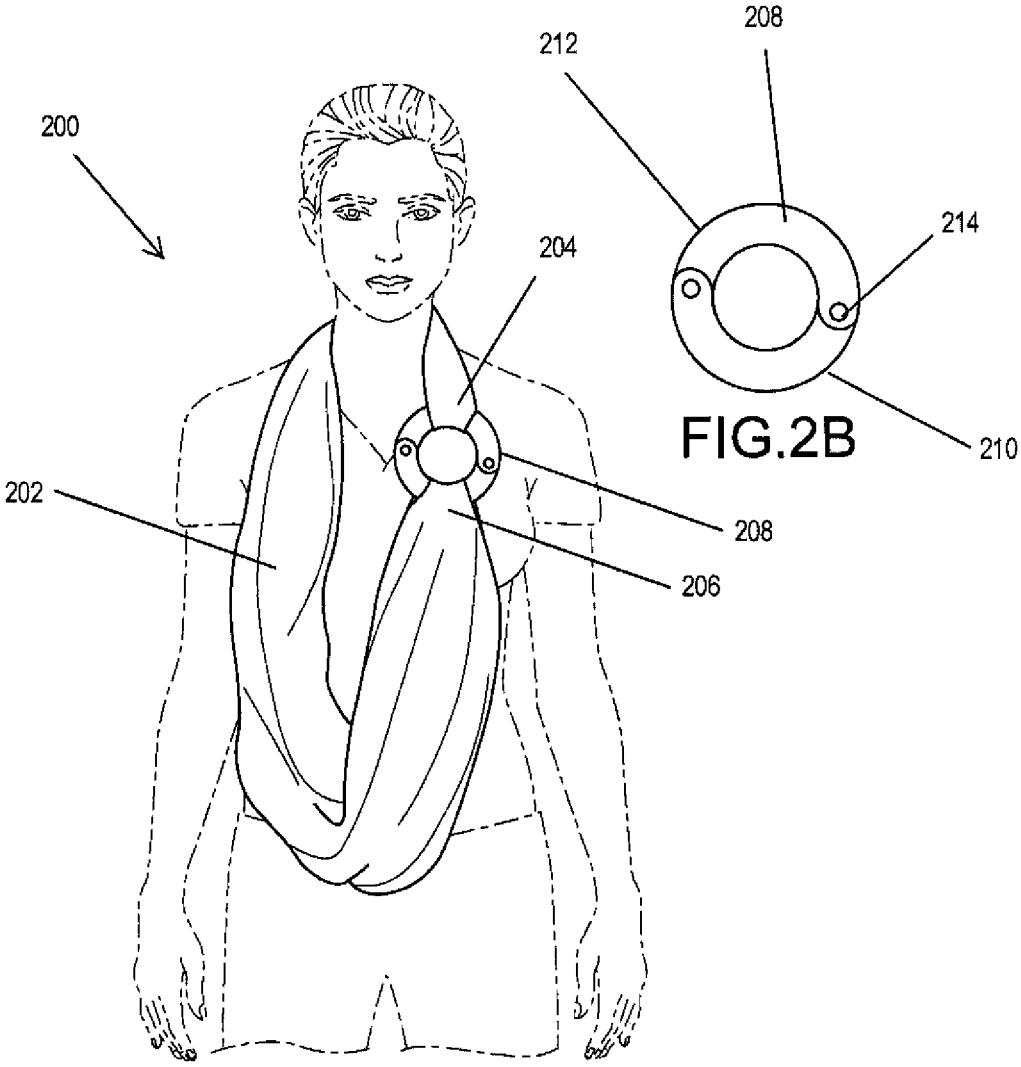
FIG. 2A depicts an embodiment of a teething scarf according to embodiments.
FIG. 2B is an annular teething element of the teething scarf of FIG. 2A according to embodiments.

FIG. 2A depicts another embodiment of a teething scarf 200. Teething scarf 200 may be similar to teething scarf 100 and may include a fabric sheet 202 having a first end 204 and a second end 206. The teething scarf 200 may also include at least one teething element 208, which may be secured to the fabric sheet 202 using any of the techniques described above. As seen in FIG. 2B, teething element 208 is in the form of a teething ring having an annular shape and a circular cross-sectional shape. While shown here with constant radius circular shapes, it will be appreciated that other shapes and cross-sections may be used. In some embodiments a thickness and/or shape of a side and/or a cross-section may vary such that the teething element 208 is irregularly shaped. Teething element 208 may include multiple sections, such as section 210 and section 212. These sections may be coupled with one another to form an annular member. For example, section 210 and section 212 (which may or may not be of the same size) may form arc-like portions that are coupled at their ends to one another to form the annular member. In some embodiments, rivets 214 or other fasteners may extend through multiple sections 210, 212 to secure the ends together. In some embodiments, the rivets 214 or other fasteners may be disengaged from the end of one or more of the sections 210 and/or 212 such that the sections 210 and 212 may be pivoted relative to one another, such as about a hinge and/or an opposite rivet 214. This allows the teething element 208 to be opened such that the end of section 210 and/or 212 may be removed from a loop formed in an end 204 and/or 206 of the fabric sheet 202. In other embodiments, the teething element 208 may be permanently coupled with the fabric sheet 202.

Figures 3A, 3B:
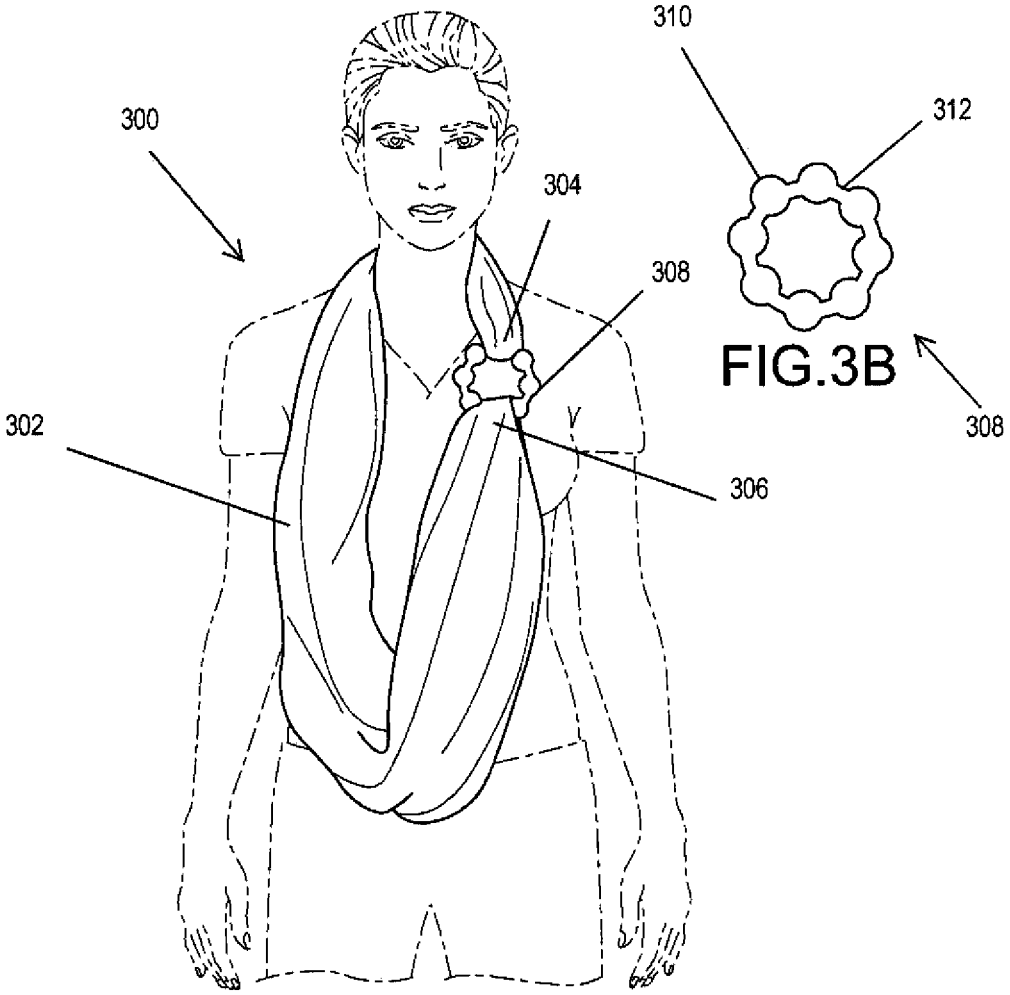
FIG. 3A depicts an embodiment of a teething scarf according to embodiments.
FIG. 3B is an annular teething element of the teething scarf of FIG. 3A according to embodiments.

FIG. 3A depicts an embodiment of a teething scarf 300. Teething scarf 300 may be similar to teething scarf 100 and may include a fabric sheet 302 having a first end 304 and a second end 306. The teething scarf 300 may also include at least one teething element 308, which may be secured to the fabric sheet 302 using any of the techniques described above. As seen in FIG. 3B, teething element 308 is in the form of a teething ring having an irregular annular shape. Here, a number of orb-like bulbs 310 are spaced along a circumference of the teething element 308 with thinner, round segments 312 positioned between each of the bulbs 310 to connect the bulbs 310 in an annular arrangement. While shown here with spherical bulbs 310, it will be appreciated that other shapes and cross-sections may be used. For example, ellipsoid and/or other shapes with curved profiles and/or rounded corners may be used as bulbs 310. In some embodiments each bulb 310 may be the same shape and/or size, while in other embodiments one or more of the bulbs 310 may be different. Bulbs 310 may be spaced about the circumference of the teething element 308 at regular or irregular intervals.

It will be appreciated that the annularly shaped teething members described above may be coupled with their respective fabric sheets in different ways. As just one example, the fabric sheet may be received within a central aperture defined by an annular teething element. This may allow a position of the teething element to be adjusted by sliding the teething element along a length of the fabric sheet. In other embodiments, the teething element may be secured to a particular location on the fabric sheet, such as by using stitching.

Figures 4A, 4B:
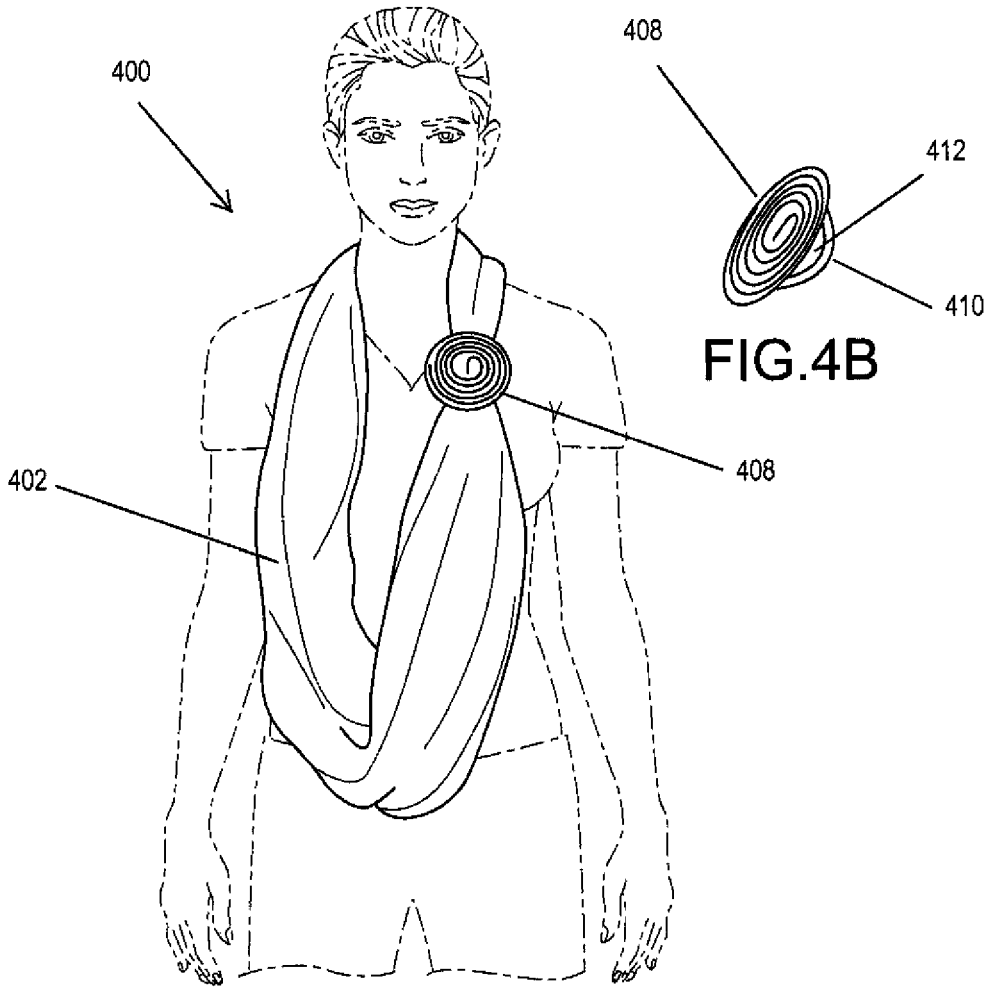
FIG. 4A depicts an embodiment of a teething scarf according to embodiments.
FIG. 4B illustrates a shanked teething element of the teething scarf of FIG. 4A according to embodiments.

FIG. 4A depicts an embodiment of a teething scarf 400. Teething scarf 400 may be similar to teething scarf 100 and may include a fabric sheet 402 having a first end and a second end (not shown). The teething scarf 400 may also include at least one teething element 408, which may be secured to the fabric sheet 402 using any of the techniques described above. As seen in FIG. 4B, teething element 408 is in the form of a decorative disk. Teething element 408 may have any shape, pattern, and/or design. As shown here, teething element 408 is a generally circular disk having a spiral pattern provided on a front surface of the teething element 408. A shank 410 may project away from a back surface of the teething element 408. For example, shank 410 and/or the rear surface of the teething element 408 may define an opening 412 that is configured to receive the fabric sheet 402. For example, shank 410 may define an entire outer periphery of opening 412 such that a portion of the shank 410 entirely surrounds a portion of the fabric sheet 402. In other embodiments, shank 410 may define only a portion of the outer periphery of opening 412, with a remaining portion of the outer periphery of opening 412 being defined by the back surface of the teething element 408. While shown here as being generally arcuate, it will be appreciated that shank 412 may have the form of other shapes, such as rectangular, triangular, and/or other polygonal shapes or portions thereof.

In some embodiments, the fabric sheet 402 may be inserted through the opening 412, with the teething element 408 being secured to a portion of the fabric sheet 402. For example, stitches, adhesives, and/or other securement techniques may be used to secure the shank 410 at a particular position along a length of the fabric sheet 402. In other embodiments, the shank 410 and teething element 408 may not be secured to a single position on the fabric sheet 402. In such embodiments, a position of the teething element 408 may be adjusted by sliding the shank 410 along a length of the fabric sheet 402. This adjustability is particularly useful in that it makes it easier for a wearer of the teething scarf 400 to wrap the scarf 400 around their neck with the teething element 408 in a position near where an infant's mouth will be. For example, the wearer may just wrap the scarf 400 around their neck in any fashion, without worrying about the position of the teething element 408. Once the scarf 400 is in the desired position, the wearer may slide the teething element 408 into a desired location based on the desired appearance and/or based on how they plan on holding an infant.

In some embodiments, the fabric sheet 402 may be formed such that a first end and a second end of the fabric sheet 402 are coupled with one another. For example, the ends may be stitched or otherwise joined together such that the fabric sheet 402 forms a continuous loop without any intervening components. In other embodiments, the first end and the second end may each be coupled with the shank 410 such that the fabric sheet 402 and teething element 408 together form the continuous loop.

Figures 5A, 5B:
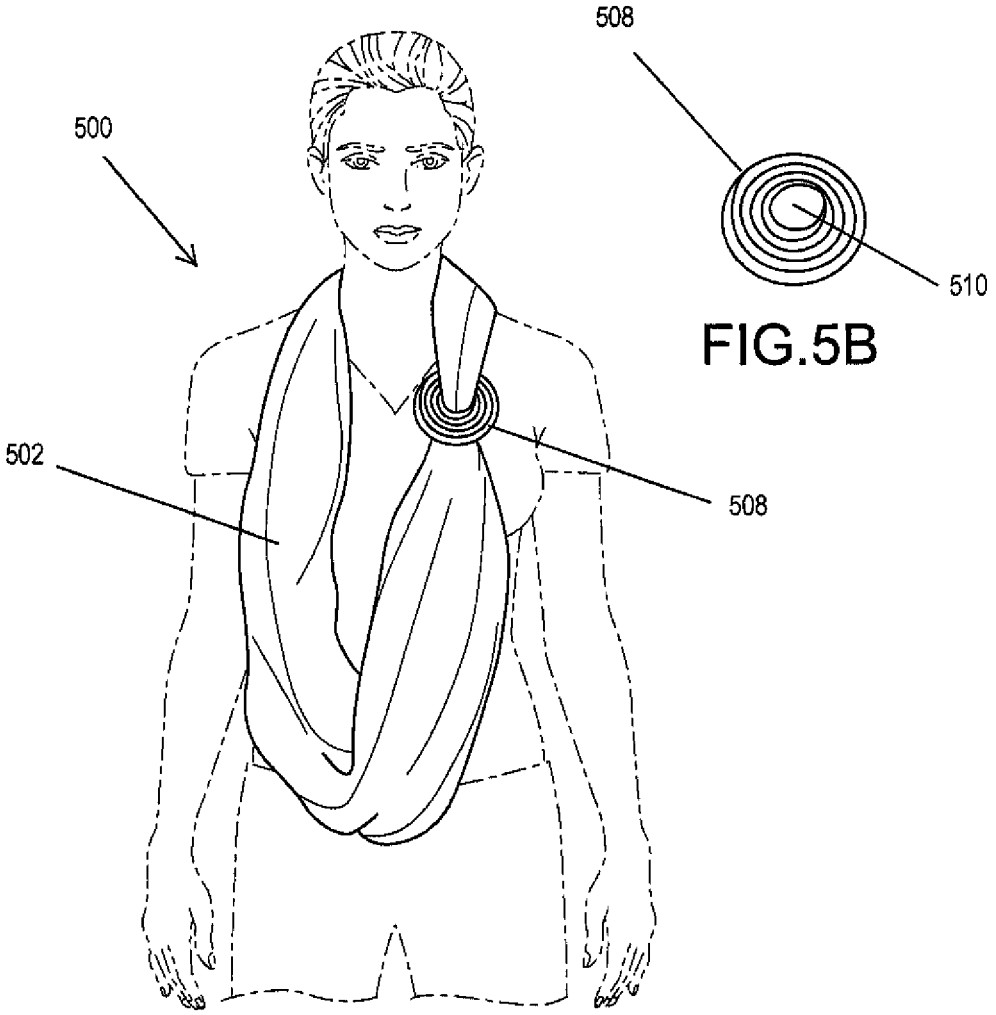
FIG. 5A depicts an embodiment of a teething scarf according to embodiments.
FIG. 5B is an annular teething element of the teething scarf of FIG. 5A according to embodiments.

FIG. 5A depicts an embodiment of a teething scarf 500. Teething scarf 500 may be similar to teething scarf 100 and may include a fabric sheet 502 having a first end and a second end (not shown). The teething scarf 500 may also include at least one teething element 508, which may be secured to the fabric sheet 502 using any of the techniques described above. For example, the teething element 508 may be an annular member that defines a central opening 510 (shown in FIG. 5B) that receives a portion of the fabric sheet 502. In some embodiments, the fabric sheet 502 may be formed such that a first end and a second end of the fabric sheet 502 are coupled with one another. For example, the ends may be stitched or otherwise joined together such that the fabric sheet 502 forms a continuous loop without any intervening components. This continuous loop may extend through the central opening 510. In some embodiments, the fabric sheet 502 may be inserted through the opening 510, with the teething element 508 being secured to a portion of the fabric sheet 502. For example, stitches, adhesives, and/or other securement techniques may be used to secure the teething element 508 at a particular position along a length of the fabric sheet 502. In other embodiments, the teething element 508 may not be secured to a single position on the fabric sheet 502. In such embodiments, a position of the teething element 508 may be adjusted by sliding the teething element 508 along a length of the fabric sheet 502. This adjustability is particularly useful in that it makes it easier for a wearer of the teething scarf 500 to wrap the scarf 500 around their neck with the teething element 508 in a position near where an infant's mouth will be. For example, the wearer may just wrap the scarf 500 around their neck in any fashion, without worrying about the position of the teething element 508. Once the scarf 500 is in the desired position, the wearer may slide the teething element 508 into a desired location based on the desired appearance and/or based on how they plan on holding an infant. In some embodiments, the ends of fabric sheet 502 may be coupled to one another using fasteners, such as zippers, buttons, snaps, hook and loop fasteners, clasps, and the like. This allows the ends to be separated from one another such that the fabric sheet 502 may be removed from the central opening 510 of the teething element 508.

As seen in FIG. 5B, teething element 508 is in the form of an annular member having a decorative pattern on its front surface. Any such pattern (or blank design) may be used on the front surface. Here, teething element 508 includes a spiral pattern that extends between the central opening 510 and an outer periphery of the teething element 508. As shown here, teething element 508 has a generally circular outer periphery, however other shapes of teething elements 508 that define a central opening 510 may be used. It will be appreciated that while described as being in a center of the teething element 508, central opening 510 may be offset from a center of the teething element 508.

Figures 6A, 6B:
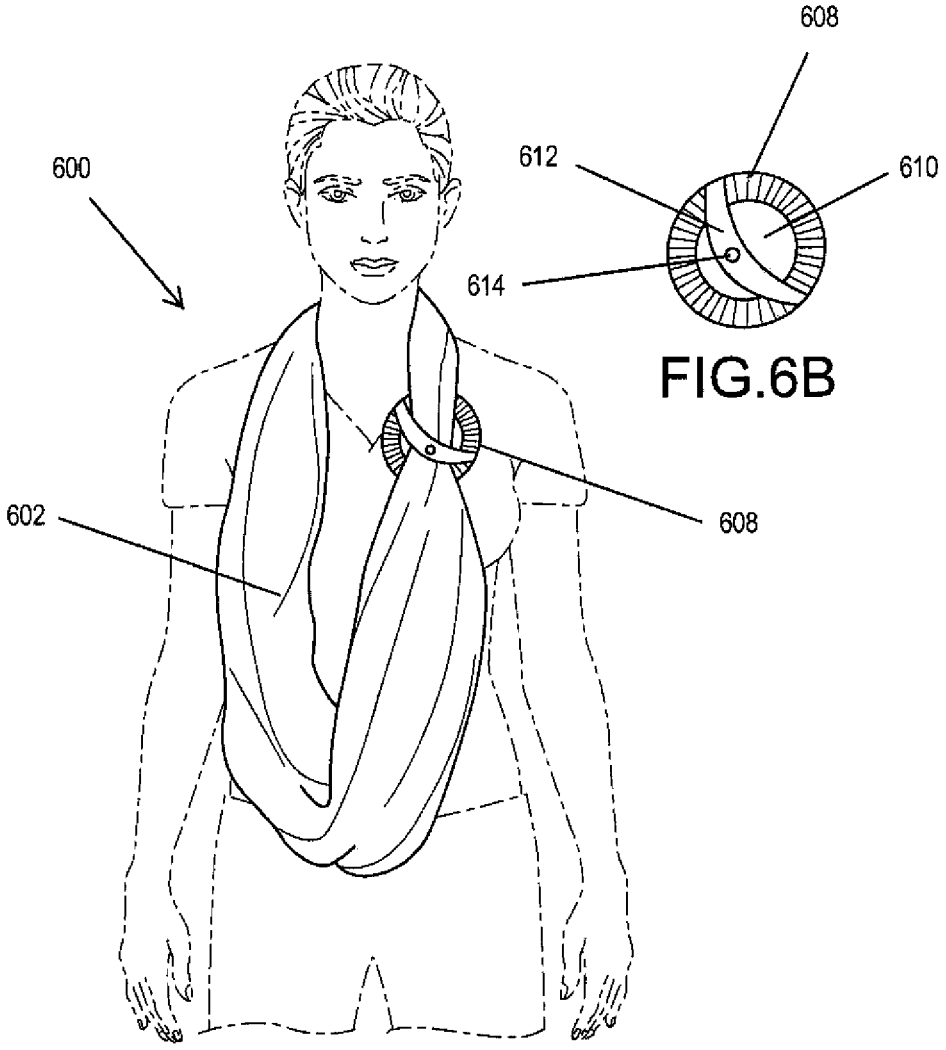
FIG. 6A depicts an embodiment of a teething scarf according to embodiments.
FIG. 6B illustrates an annular teething element with a strap of the teething scarf of FIG. 6A according to embodiments.

FIG. 6A depicts an embodiment of a teething scarf 600. Teething scarf 600 may be similar to teething scarf 100 and may include a fabric sheet 602 having a first end and a second end (not shown). The teething scarf 600 may also include at least one teething element 608, which may be secured to the fabric sheet 602 using any of the techniques described above. For example, the teething element 608 may be an annular member that defines a central opening 610 (shown in FIG. 6B) that receives a portion of the fabric sheet 602 and/or is placed behind the fabric sheet 602. In some embodiments, the fabric sheet 602 may be formed such that a first end and a second end of the fabric sheet 602 are coupled with one another. For example, the ends may be stitched or otherwise joined together such that the fabric sheet 602 forms a continuous loop without any intervening components. In some embodiments, the fabric sheet 602 may be secured to a particular location of the fabric sheet 602. For example, stitches, adhesives, and/or other securement techniques may be used to secure the teething element 608 at a particular position along a length of the fabric sheet 602. In other embodiments, the teething element 608 may not be secured to a single position on the fabric sheet 602. In such embodiments, a position of the teething element 608 may be adjusted by sliding the teething element 608 along a length of the fabric sheet 602.

As seen in FIG. 6B, teething element 608 is in the form of an annular member having a decorative pattern on its front surface. Any such pattern (or blank design) may be used on the front surface. Here, teething element 608 includes a pattern of radially extending lines along the annular member. In the present embodiment, the radially extending lines are positioned at irregular intervals, although it will be appreciated that regular intervals may be used. As shown here, teething element 608 has a generally circular outer periphery, however other shapes of teething elements 608 that define a central opening 610 may be used. It will be appreciated that while described as being in a center of the teething element 608, central opening 610 may be offset from a center of the teething element 608.

In some embodiments, a material strap 612 may be provided to help secure the teething element 608 at a particular position along a length of the fabric sheet 602. For example, the strap 612 may extend across at least a portion of the central opening 610. A pin 614 or other fastener, such as a snap or button, may be positioned in a medial portion of the strap 612. The pin 614 may be inserted through the fabric sheet 602 to secure the teething element 608 at the particular position. In some embodiments, the fabric sheet 602 may be inserted through the central opening 610, however as shown here, the fabric sheet 602 is sandwiched between the main body of the teething element 608 and the strap 612. For example, the main body of the teething element 608 is behind the fabric sheet 602 while the strap 610 is in front of the fabric sheet 602. In some embodiments, rather than including a pin or fastener, the strap 612 may be plain or include one or more decorative elements. In some embodiments, one or both ends of the strap 612 may be detachable from the main body of the teething element 608. This allows one or both ends of the straps to be removed such that the teething element 608 may be removed from the fabric sheet 602. In some embodiments, the teething element 608 including a strap 612 may have a solid main body that does not define a central opening 610.

Figures 7A, 7B:
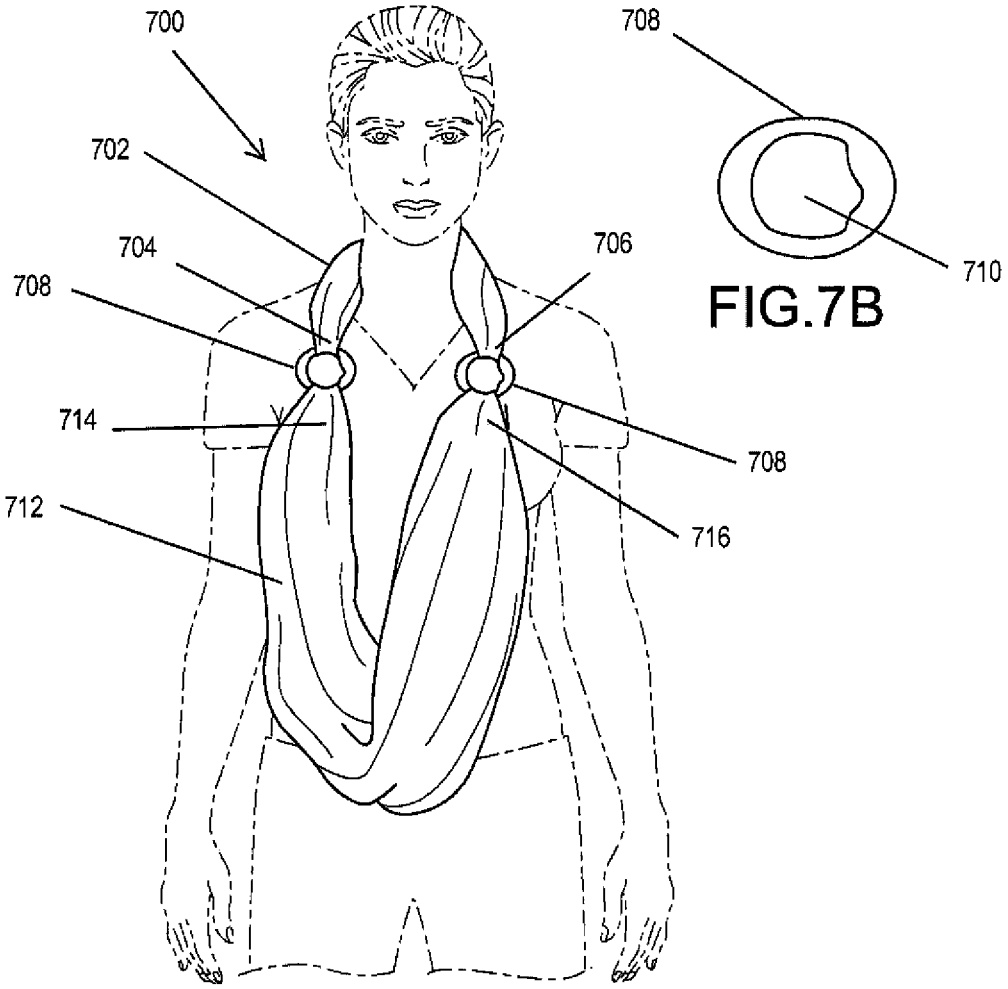
FIG. 7A depicts an embodiment of a teething scarf having multiple teething elements and fabric sheets according to embodiments.
FIG. 7B depicts one of the teething elements of the teething scarf of FIG. 7A according to embodiments.

In some embodiments, multiple teething elements and/or multiple fabric sheets may be used in a single teething scarf. For example, FIG. 7A shows an embodiment of a teething scarf 700 that includes both multiple teething elements 708 and multiple fabric sheets 702 and 712. As illustrated, a pair of teething elements 708 join a first fabric sheet 702 and a second fabric sheet 712 to form a ring-like teething scarf 700. The ends 704 and 706 of the first fabric sheet 702 may couple to a top or bottom of each teething element 708, such as by wrapping around a portion of the teething element 708 such that each end 704, 706 may be coupled to itself (e.g., be sewn). Similarly, ends 714 and 716 of the second fabric sheet 712 may couple to an opposite side of each teething element 708. This allows the two fabric sheets 702 and 712 to be coupled end to end in the form of a continuous loop, with the teething elements 708 serving as linkages that connect the fabric sheets 702 and 712. While shown here with two teething elements 708 and two fabric sheets 702 and 712, it will be appreciated that other combinations of numbers of fabric sheets and teething elements may be used.

As seen in FIG. 7B, each teething element 708 is in the form of a teething ring having an irregular annular shape. Here, each teething element 708 has an ellipsoid outer periphery (other shapes may be used) and may define a central opening 710. The outer periphery of the central opening 710 may or may not have a shape corresponding to the shape of the outer periphery of the teething element 708. Here, central opening 710 has an irregular shape such that the sides of the teething element 708 are thicker than the top and bottom of the ring. Additionally, central opening 710 may have a non-elliptical shape. For example, one or both sides of the central opening 710 may have a flattened edge that may include a notched portion.

It will be appreciated that the annularly shaped teething members described above may be coupled with their respective fabric sheets in different ways. As just one example, the fabric sheet may be received within a central aperture defined by an annular teething element. This may allow a position of the teething element to be adjusted by sliding the teething element along a length of the fabric sheet. In other embodiments, the teething element may be secured to a particular location on the fabric sheet, such as by using stitching. It will also be appreciated that other types of teething elements may be used in similar embodiments to connect ends of multiple fabric sheets together. Additionally, fabric sheets 702 and 712 have the same dimensions or may have at least some differences in dimensions. While teething elements 708 are shown to be identical, it will be appreciated that different teething elements may be used on either side of the scarf 700.

Figures 8A, 8B:
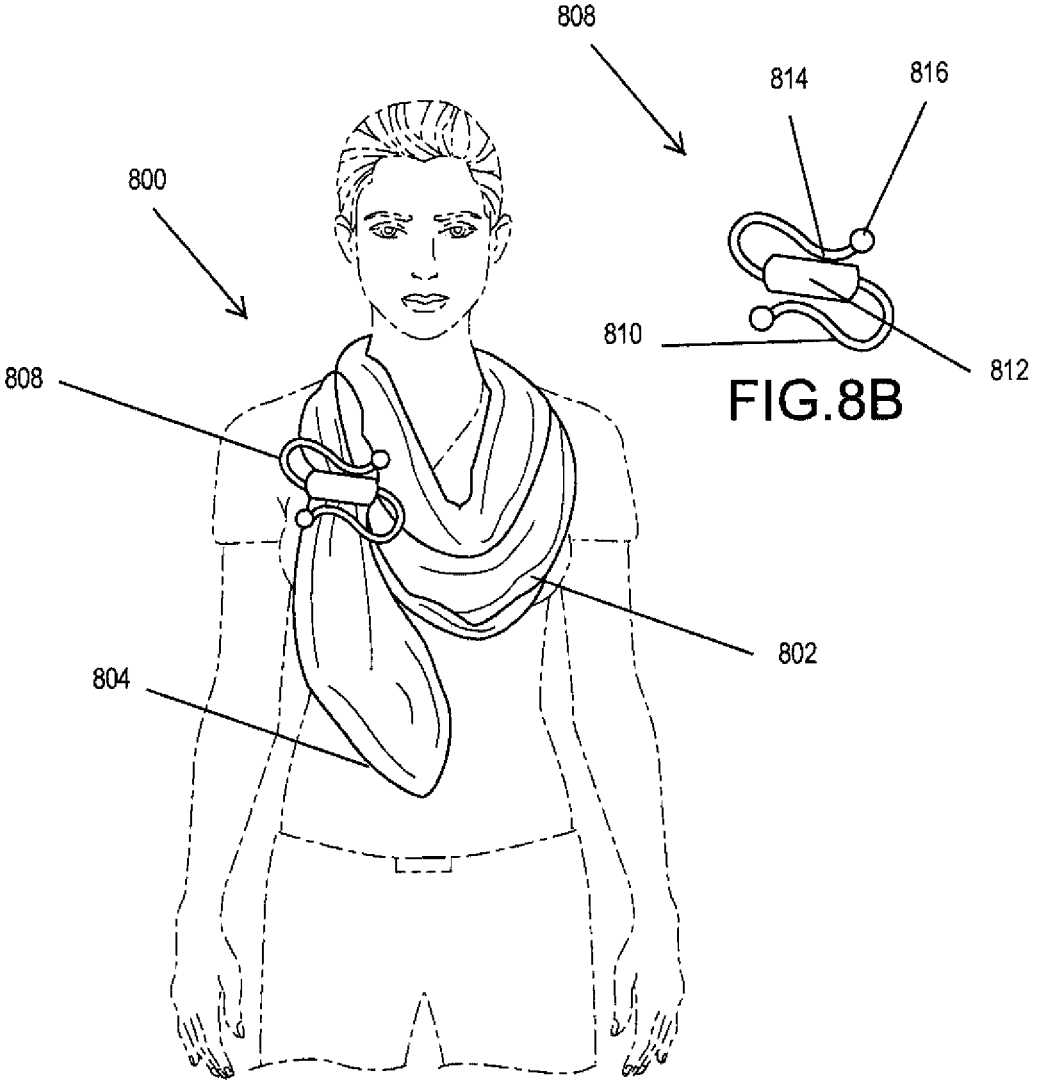
FIG. 8A depicts an embodiment of a teething scarf having an s-shaped teething element according to embodiments.
FIG. 8B depicts the s-shaped teething element of FIG. 8A according to embodiments.

In other embodiments, one or more fabric sheets may form a teething scarf that is not in the form of an infinity scarf. For example, FIG. 8A shows a teething scarf 800 is formed from a fabric sheet 802 that is coupled with a teething element 808. Fabric sheet 802 includes a first end 804 and a second end (not shown) that are not coupled with one another. Instead, the teething scarf 800 relies on teething element 808 to secure medial portions of the fabric sheet 802 together. As shown in FIG. 8B, teething element 808 is generally s-shaped with wire-like curved sections 810 being coupled to a main body 812. In some embodiments, medial portion 814 of each curved section 810 is configured to contact or nearly contact the main body 812, allowing the curved sections 810 to serve as clips or clamps that can secure a portion of the fabric sheet 802 between one of the curved sections 810 and the main body 812. In such embodiments, the scarf 800 may be worn by a user wrapping the scarf 800 around their neck and/or shoulders in a desired fashion. The teething element 808 may then be positioned at a desired location, possibly by clipping a portion of the fabric sheet 802 in between the curved sections 810 and the main body 812 to secure both the scarf 800 and the teething element 808 in a desired position. In other embodiments, the main body 812 may be in the form of a sleeve that is configured to receive a portion of the fabric sheet 802. In some embodiments, distal ends of each of the curved sections 810 may terminate in bulbs 816. Bulbs 816 may be configured to provide rounded ends that are safe for an infant to chew or otherwise interact with. Bulbs 816 may be spherical or any other rounded shape. It will be appreciated that some or all of the teething element 808 may be formed from teething-safe materials.

Figure 9A:
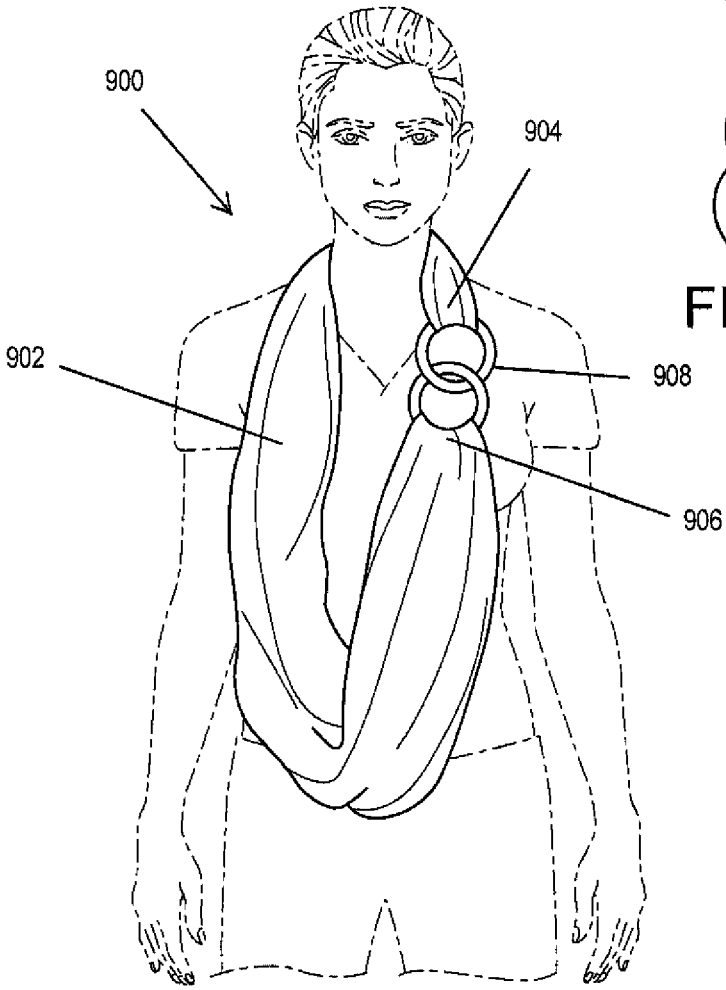
FIG. 9A depicts an embodiment of a teething scarf with interlocking teething elements according to embodiments.
Figure 9B:
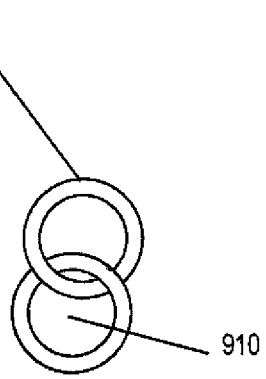
FIG. 9B depicts the interlocking teething elements of FIG. 9A according to embodiments.

In some embodiments, multiple teething elements may be used with a single fabric sheet. FIG. 9A depicts a teething scarf 900 that is formed from a fabric sheet 902 that has a first end 904 and a second end 906. The first end 904 and the second end 906 are joined together using a pair (or other number) of teething elements 908 to form a continuous loop, such as an infinity scarf. Fabric sheet 902 may be similar to those described elsewhere herein. The first end 904 of the fabric sheet 902 may be coupled to a first one of the teething elements 908 and the second end 906 may be coupled to a second one of the teething elements 908. The two teething elements 908 may be coupled to one another to complete the continuous loop. As shown in FIG. 9B, teething elements 908 include annular elements that are interlinked. For example, the teething elements 908 may be circular and define central openings 910 that are configured to receive the other teething element 908 and/or a portion of the fabric sheet 902. It will be appreciated that other shapes and numbers of teething elements may be used in similar arrangements.

Figures 10A, 10B:
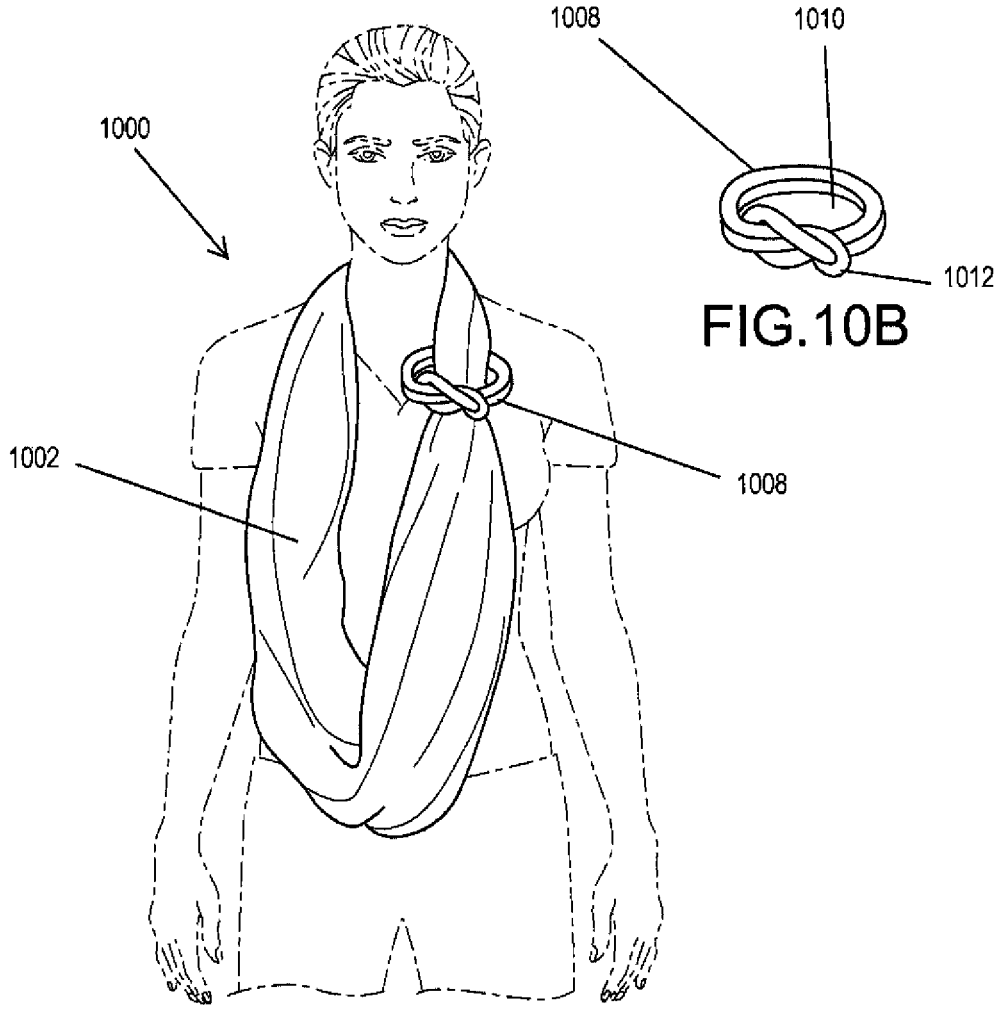
FIG. 10A depicts an embodiment of a teething scarf with an annular teething element according to embodiments.
FIG. 10B depicts the annular teething element of FIG. 10A according to embodiments.

FIG. 10A depicts an embodiment of a teething scarf 1000. Teething scarf 1000 may be similar to teething scarf 100 and may include a fabric sheet 1002 having a first end and a second end (not shown). The teething scarf 1000 may also include at least one teething element 1008, which may be secured to the fabric sheet 1002 using any of the techniques described above. For example, the teething element 1008 may be an annular member that defines a central opening 1010 (shown in FIG. 10B) that receives a portion of the fabric sheet 1002. In some embodiments, the fabric sheet 1002 may be formed such that a first end and a second end of the fabric sheet 1002 are coupled with one another. For example, the ends may be stitched or otherwise joined together such that the fabric sheet 1002 forms a continuous loop without any intervening components. This continuous loop may extend through the central opening 1010. In some embodiments, the fabric sheet 1002 may be inserted through the opening 1010, with the teething element 1008 being secured to a portion of the fabric sheet 1002. For example, stitches, adhesives, and/or other securement techniques may be used to secure the teething element 1008 at a particular position along a length of the fabric sheet 1002. In other embodiments, the teething element 1008 may not be secured to a single position on the fabric sheet 1002. In such embodiments, a position of the teething element 1008 may be adjusted by sliding the teething element 1008 along a length of the fabric sheet 1002. This adjustability is particularly useful in that it makes it easier for a wearer of the teething scarf 1000 to wrap the scarf 1000 around their neck with the teething element 1008 in a position near where an infant's mouth will be. For example, the wearer may just wrap the scarf 1000 around their neck in any fashion, without worrying about the position of the teething element 1008. Once the scarf 1000 is in the desired position, the wearer may slide the teething element 1008 into a desired location based on the desired appearance and/or based on how they plan on holding an infant.

As seen in FIG. 10B, teething element 1008 is in the form of a decorative annular member. Here, teething element 1008 is formed to be a loop formed by a wire or cord-like structure that is wrapped around a central axis (and the central opening 1010) with a knot 1012 formed a one or more positions around an outer periphery of the teething element 1008. As shown here, teething element 1008 has a generally circular outer periphery (with portions of the knot 1012 interrupting the circularly shape), however other shapes of teething elements 1008 that define a central opening 1010 may be used. It will be appreciated that while described as being in a center of the teething element 1008, central opening 1010 may be offset from a center of the teething element 1008.

Figures 11A, 11B:
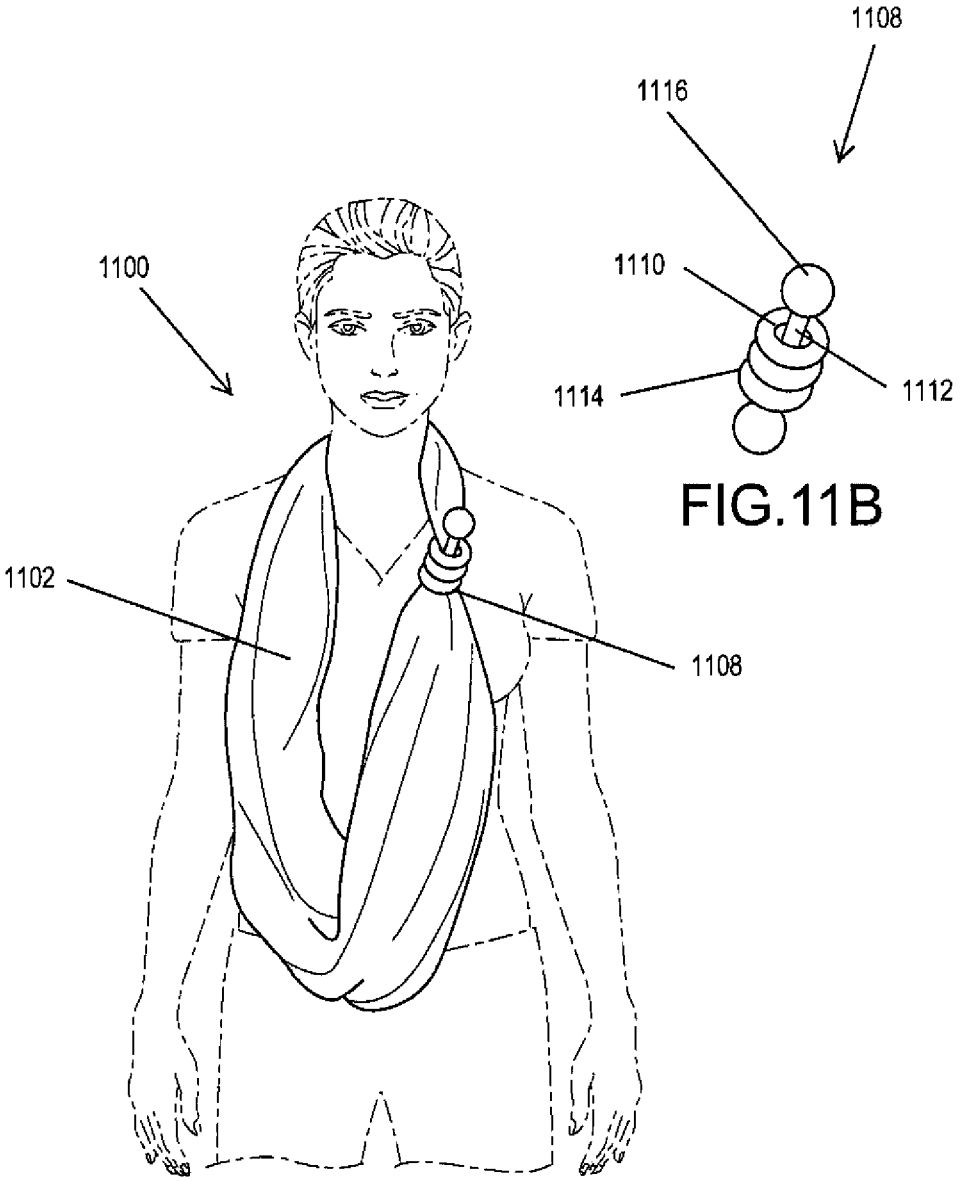
FIG. 11A depicts an embodiment of a teething scarf having a rod and ring teething element according to embodiments.
FIG. 11B depicts the rod and ring teething element of FIG. 11A according to embodiments.

FIG. 11A depicts an embodiment of a teething scarf 1100. Teething scarf 1100 may be similar to teething scarf 100 and may include a fabric sheet 1102 having a first end and a second end (not shown). The teething scarf 1100 may also include at least one teething element 1108, which may be secured to the fabric sheet 1102 using any of the techniques described above. For example, the teething element 1108 may be an annular tubular member that defines a central opening 1110 (shown in FIG. 11B) that receives a portion of the fabric sheet 1102. In some embodiments, the fabric sheet 1102 may be formed such that a first end and a second end of the fabric sheet 1102 are coupled with one another. For example, the ends may be stitched or otherwise joined together such that the fabric sheet 1102 forms a continuous loop without any intervening components. This continuous loop may extend through the central opening 1110. In some embodiments, the fabric sheet 1102 may be inserted through the opening 1110, with the teething element 1108 being secured to a portion of the fabric sheet 1102. For example, stitches, adhesives, and/or other securement techniques may be used to secure the teething element 1108 at a particular position along a length of the fabric sheet 1102. In other embodiments, the teething element 1108 may not be secured to a single position on the fabric sheet 1102. In such embodiments, a position of the teething element 1108 may be adjusted by sliding the teething element 1108 along a length of the fabric sheet 1102. This adjustability is particularly useful in that it makes it easier for a wearer of the teething scarf 1100 to wrap the scarf 1100 around their neck with the teething element 1108 in a position near where an infant's mouth will be. For example, the wearer may just wrap the scarf 1100 around their neck in any fashion, without worrying about the position of the teething element 1108. Once the scarf 1100 is in the desired position, the wearer may slide the teething element 1108 into a desired location based on the desired appearance and/or based on how they plan on holding an infant.

As seen in FIG. 11B, teething element 1108 forms a sleeve that receives a portion of the fabric sheet 1102. Here, teething element 1108 is formed by a rod 1112 that is encircled by a number of rings 1114. The space between the rod 1112 and the inner surfaces of each of the rings 1114 defining the central opening 1110. In this embodiment, the central opening 1110 has a greater depth than width and may be configured to scrunch up a portion of the fabric sheet 1102. This allows a position of the teething element 1108 to be maintained without the use of any fasteners. For example, the user may slide the teething element 1108 into a desired position and the tightness of the central opening 1110 may scrunch the fabric sheet 1102 sufficiently to secure the teething element 1108 at that position. Rod 1112 may have ends 1116 that are larger than a medial portion of the rod 1112. Ends 1116 may be rounded, such as by being spherical bulbs that provide a rounded, infant-safe surface. Rings 1114 may have central openings that are smaller than the ends 1116 such that the rings 1114 may not be removed from the rod 1112. In some embodiments, rod 1112 and rings 1114 may be formed from the same materials, while in other embodiments the components may be formed from different materials. As shown here, teething element 1108 has a cylindrical rod 1112 surrounded by circular rings 1114. It will be appreciated that other shapes of rods and/or rings may be contemplated.

Figures 12A, 12B:
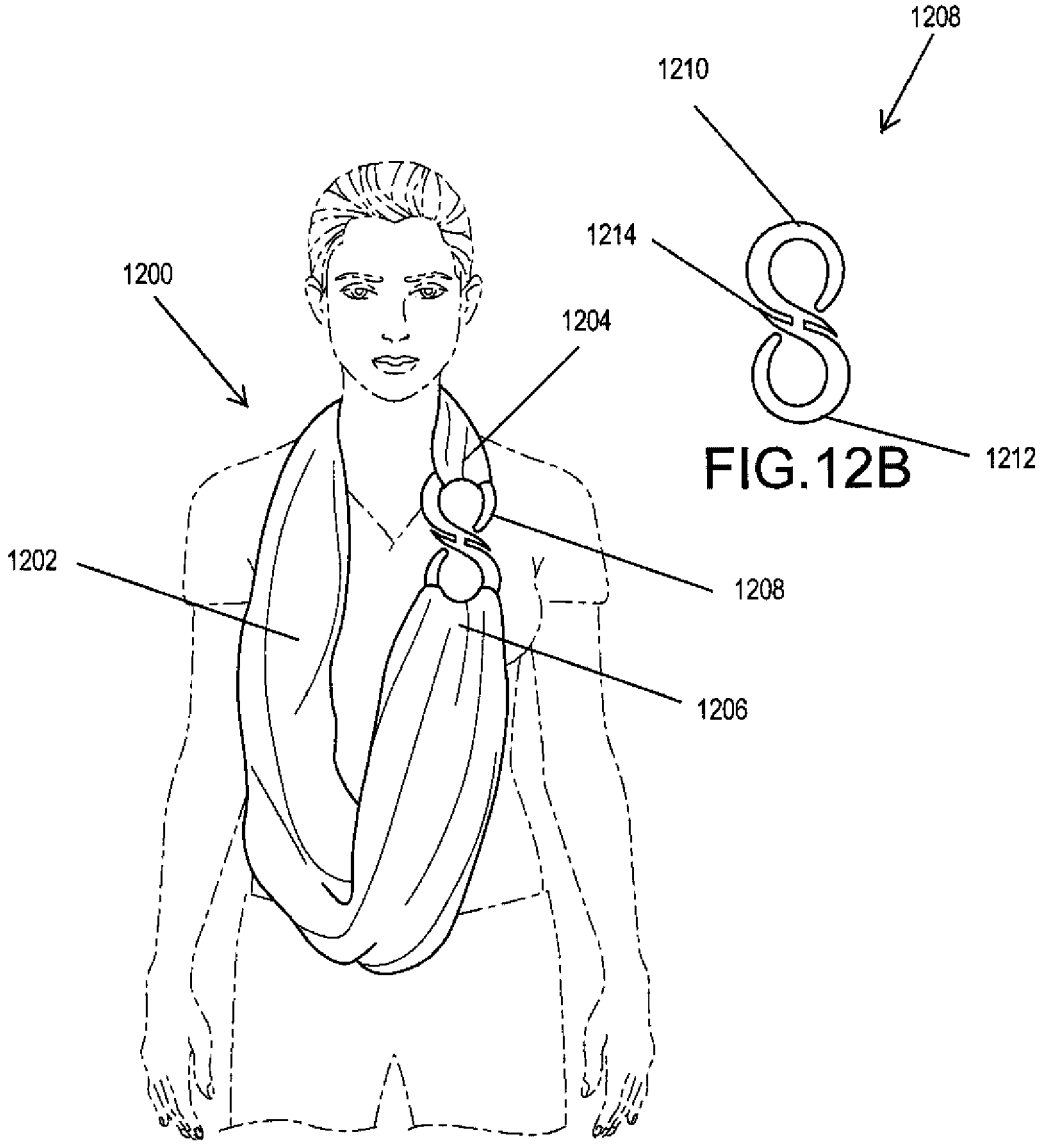
FIG. 12A depicts an embodiment of a teething scarf having an s-shaped teething element according to embodiments.
FIG. 12B depicts the s-shaped teething element of FIG. 12A according to embodiments.

FIG. 12A depicts another embodiment of a teething scarf 1200. Teething scarf 1200 may be similar to teething scarf 100 and may include a fabric sheet 1202 having a first end 1204 and a second end 1206. The teething scarf 1200 may also include at least one teething element 1208, which may be secured to the fabric sheet 1202 using any of the techniques described above. Teething scarf 1200 may form a continuous loop with the first end 1204 and the second end 1206 being coupled to one another using the teething element 1208 as a connecting linkage. For example, first end 1204 may be coupled to a top end 1210 of the teething element 1208 and the second end 1206 may be coupled to a bottom end 1212 of the teething element 1208. As seen in FIG. 12B, teething element 1208 is s-shaped or in a near figure eight shape with the top end 1210 being separated from the bottom end 1212 by a medial portion 1214. While shown here with a gap between a tip of each end 1210, 1212 and the medial portion 1214, it will be appreciated that in some embodiments the tip of each end 1210, 1212 may contact and/or join the medial portion 1214. The use of an s-shaped and/or figure eight-shaped teething element 1208 may serve to separate the ends 1204 and 1206 of the fabric sheet 1202. In embodiments where there are gaps between a tip of each end 1210, 1212 and the medial portion 1214, the gaps may be used to unhook the fabric sheet 1202 from the teething element 1208.

Figure 13B:
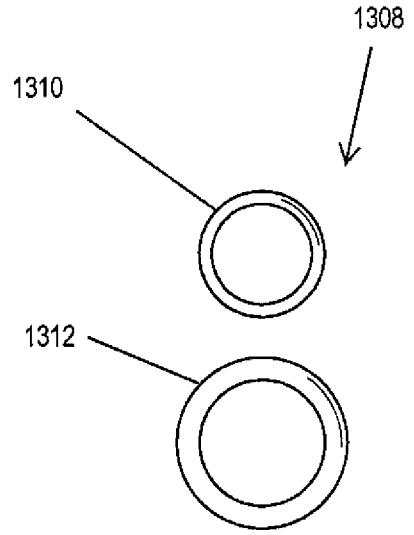
FIG. 13B depicts the nesting teething elements of FIG. 13A according to embodiments.
Figure 13A:
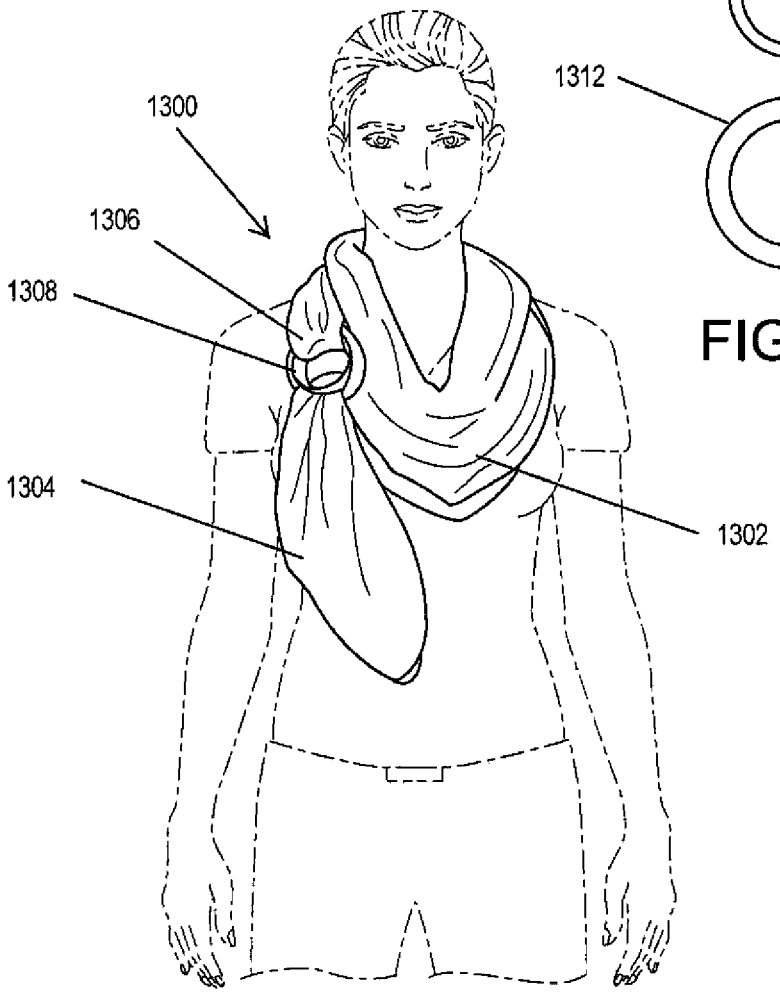
FIG. 13A depicts an embodiment of a teething scarf with nesting teething elements according to embodiments.

FIG. 13A shows a teething scarf 1300 that is formed from multiple teething elements 1308 and at least one fabric sheet 1302. Here, the teething element 1308 includes first and second rings 1310, 1312. These rings 1310, 1312 are concentric to facilitate coupling of first and second ends 1304, 1306 of the fabric sheet 1302. In some embodiments, the second end 1306 couples to the rings 1310, 1312 by wrapping around the rings 1310, 1312 and then coupling to itself (e.g., sewing). The rings 1310, 1312 couple to the first end 1304 of the fabric sheet 1302 by enabling the first end 1304 to weave between the rings 1310, 1312. This allows a portion of the first end 1304 to be secured by the teething element 1308. The rings 1310, 1312 may have a uniform cross-section or non-uniform cross-section. The rings 1310, 1312 may also differ from each other in color, material, texture, etc. In some embodiments, the fabric sheet 1302 may be formed from layers of one or more pieces/type of fabric. For example, the fabric sheet 1302 may include two differently colored pieces of fabric sewn together (e.g., light and dark colored fabric) for aesthetic reasons. Different types of fabrics may also have other benefits. For example, one of the pieces of fabric may be more absorbent (e.g., terry, cotton interlock knit) enabling a caregiver to wipe up a baby's saliva while the other piece of fabric may better conceal wet spots and/or may be more aesthetically pleasing.

As shown in FIG. 13B, rings 1310 and 1312 may be sized such that the smaller ring fits closely against the larger ring. In some embodiments, rings 1310 and 1312 may have the same thickness. As shown here the rings 1310 and 1312 have different thicknesses. Rather than concentric rings, other concentrically aligned shapes may be used to secure the teething element 1308 to the fabric sheet 1302.

Figures 14A, 14B:
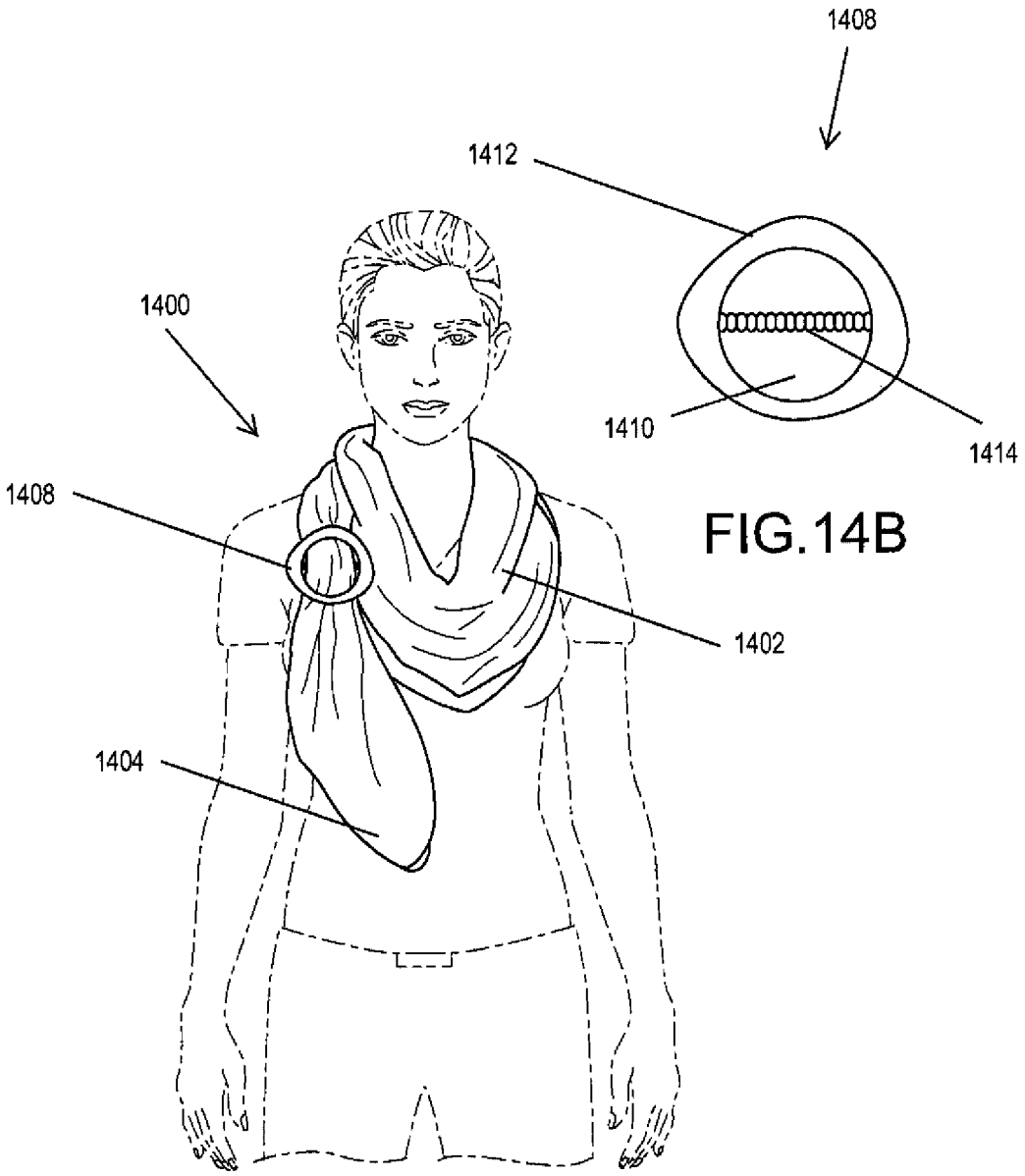
FIG. 14A depicts an embodiment of a teething scarf with an annular teething element having a cross member according to embodiments.
FIG. 14B depicts the annular teething element having a cross member of FIG. 14A according to embodiments.
Figures 15A, 15B:
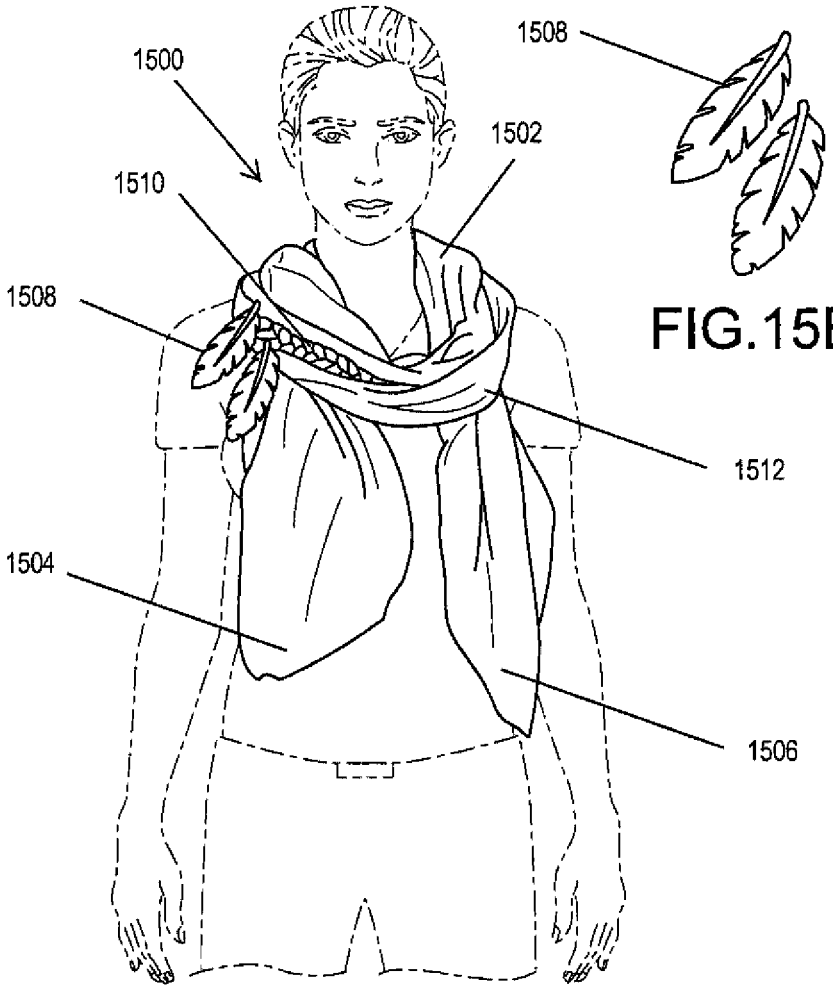
FIG. 15A depicts an embodiment of a teething scarf having leaf-shaped teething elements according to embodiments.
FIG. 15B depicts the leaf-shaped teething elements of FIG. 15A according to embodiments.

FIG. 14A depicts an embodiment of a teething scarf 1400 that is formed from a fabric sheet 1402 that is coupled with a teething element 1408. Fabric sheet 1402 includes a first end 1404 and a second end (not shown) that are not coupled with one another. As shown in FIG. 14B, teething element 1408 includes an annular main body 1412 that defines a central opening 1410. At least one cross member 1414 extends across the central opening 1410 to divide the opening into multiple sections. The first end 1404 may be weaved through the different sections of the central opening 1410 and the teething element 1408 may be pulled to a desired position. The weaving engagement may help teething element 1408 maintain the desired position without the need for stitching or fasteners. The main body 1412 may be circular or any other shape. Here, main body 1412 is generally oblong, with varying widths along its periphery. Cross member 1414 may include a texture that increases friction against the fabric sheet 1402 to help secure the teething element 1408 at a particular position. As just one example, the cross member 1414 has a number of ridges that extend transversely to a length of the cross member 1414, however, other textures (including ridges that run parallel to the length, detents, protrusions, and the like) are possible FIG. 15A depicts an embodiment of a teething scarf 1500 that includes a fabric sheet 1502 having a first and second free end 1504, 1506. The free ends 1504, 1506 enable a user to wrap the teething scarf 1500 around their neck in any number of arrangements. Fabric sheet 1502 includes a braided portion 1510 and an unbraided portion 1512. It is understood that some embodiments may have multiple braids which may be similar and/or may differ from each other not only in color but also in length, size of braids, location on the fabric sheet 1502, etc. The braided portion 1510 is coupled to at least one teething element 1508. In some embodiments, the teething elements 1508 may all couple to one of the braided portion 1510 and/or multiple braided portions 1510 are included that each may include zero or more teething elements 1510. As shown in FIG. 15B, the teething element 1508 may be formed into a variety of shapes that may be both aesthetically pleasing as well as capture the attention/interest of a baby. For example, the teething element 1508 may be formed in the shape of a leaf, feather, or other object that dangles from the braids. Here, the teething element 1508 is in the shape of a long narrow leaf. In some embodiments, the teething elements 1508 may be constrained on a single end such that one end dangles off of the scarf 1500 while in other embodiments, both ends (or other attachment points) may be secured to the fabric sheet 1502 such that the teething scarf 1500 has a more well defined appearance.

Figures 16A, 16B:
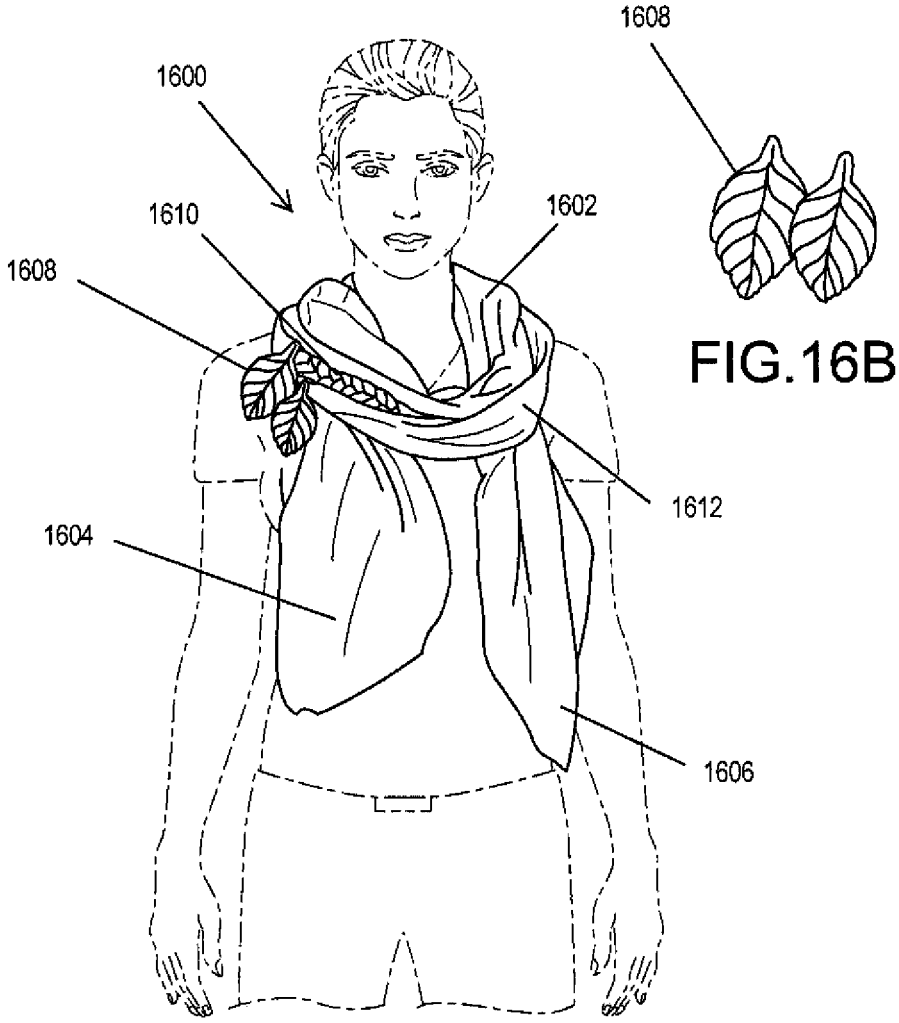
FIG. 16A depicts an embodiment of a teething scarf having leaf-shaped teething elements according to embodiments.
FIG. 16B depicts the leaf-shaped teething elements of FIG. 16A according to embodiments.

FIG. 16A depicts a teething scarf 1600 that is similar to teething scarf 1500 but with different leaf-shaped teething elements. For example, teething scarf 1600 may include a fabric sheet 1602 having free first and second ends 1604, 1606. Fabric sheet 1602 includes a braided portion 1610 and an unbraided portion 1612, with the braided portion 1610 being coupled to one or more teething elements 1608. As shown in FIG. 16B, teething elements 1608 may take the form of short, broad leaves.

Figures 17A, 17B:
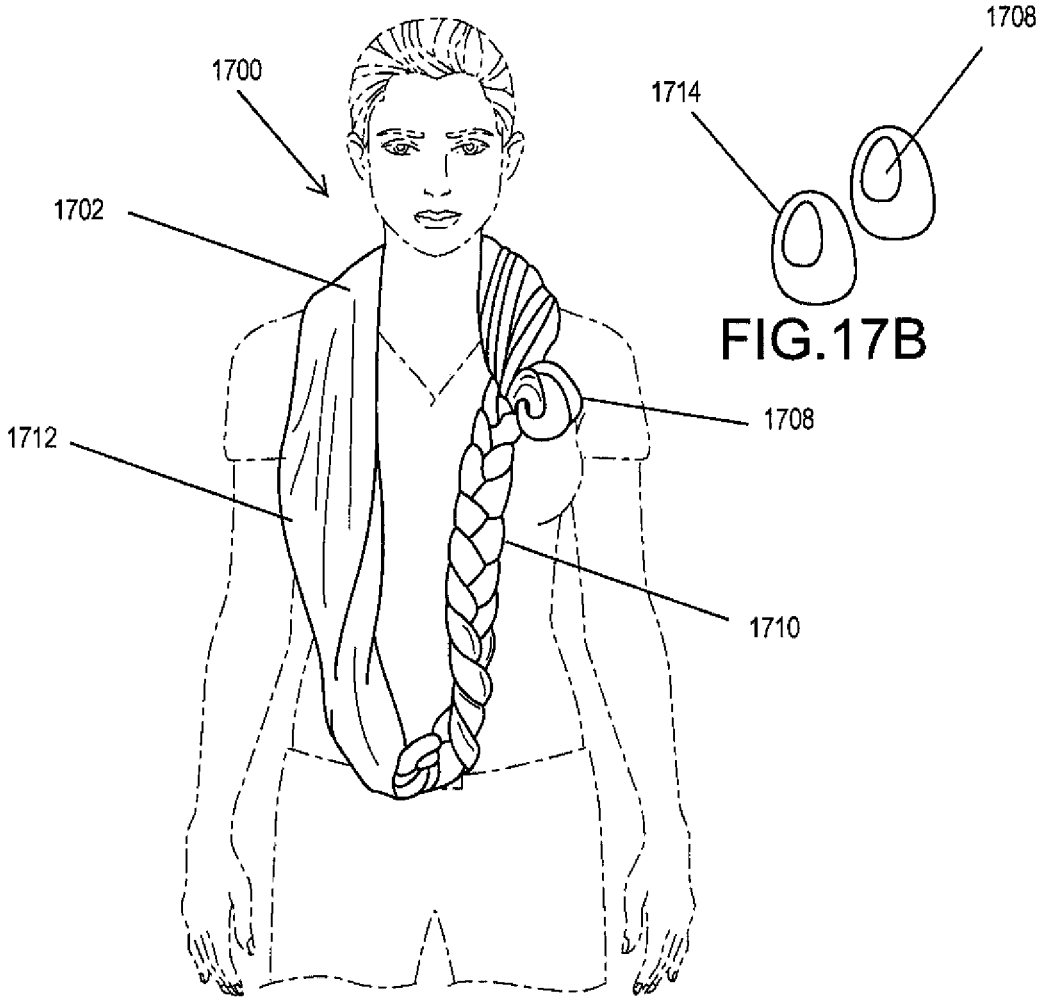
FIG. 17A depicts an embodiment of a braided teething scarf having multiple teething elements according to embodiments.
FIG. 17B depicts the teething elements of FIG. 17A according to embodiments.

FIG. 17A depicts another embodiment of a teething scarf 1700. Teething scarf 1700 includes a fabric sheet 1702 having multiple sections. For example, the fabric sheet 1702 includes a braided section 1710 and an unbraided section 1712. These sections may provide aesthetic variety but may also engage the infant. For example, the patterns and/or texture of the different sections (e.g., the braided section 1710) may attract the baby's attention. Different sections may also facilitate grabbing by the infant. For example, the braided section 1710 may be easily grabbed and held enabling the baby to hold the teething members in its mouth. In some embodiments, the sections 1710 and 1712 may couple (e.g., be sewn) to form a continuous loop or ring. In another embodiment, the fabric sheet 1702 may not form a ring, thus enabling the caregiver to wrap the teething scarf 1700 around their neck in different ways. As illustrated, the braided section 1710 may be coupled with one or more teething elements 1708. For example, the teething elements 1708 may be woven into the braided section 1710. In another embodiment, a loop may be sewn to the fabric sheet 1702 to couple the teething elements 1708 to the fabric sheet 1702. Other ways of coupling include hook and loop fasteners, eyelets, a ring that encircles the fabric sheet 1702 and/or other coupling techniques. In some embodiments, the teething elements 1708 couple to an end of the braided section 1710. In another embodiment, the teething elements 1708 may couple to another part of the fabric sheet 1702. For example, the teething elements 1708 may couple to the unbraided section 1712. In still other embodiments, both sections 1710 and 1712 may include teething elements 1708. In other words, the teething scarf 1700 may include teething elements 1708 placed at different locations. It will be further appreciated that only a single teething element 1708 or more than two teething elements 1708 may be used.

FIG. 17B depicts the teething elements 1708. Here, teething elements 1708 are roughly ovoid and each define at least one opening 1714 that is used to couple the teething element 1708 to the fabric sheet 1702. In some embodiments, the opening 1714 may be centered within the teething element 1708. However, as shown here, opening 1714 is offset from the center of the teething element. Opening 1714 is also generally ovoid, however other shapes may be used for opening 1714. While two teething elements 1708 are positioned proximate to one another on teething scarf 1700, some embodiments may space a number of teething elements along the length of one or both sections 1710, 1712.

Figure 18A:
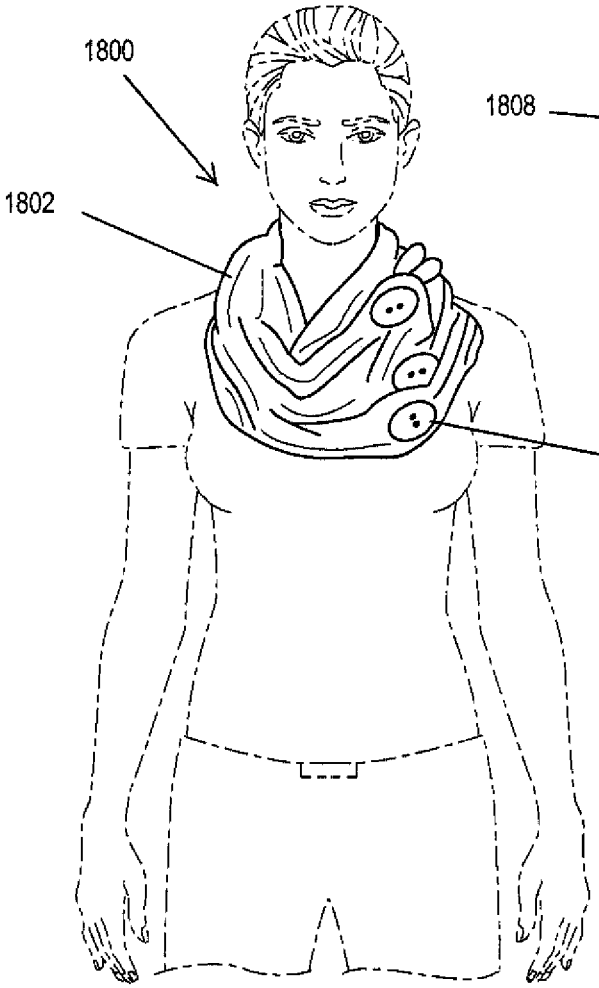
FIG. 18A depicts an embodiment of a teething scarf having button-like teething elements according to embodiments.
Figure 18B:
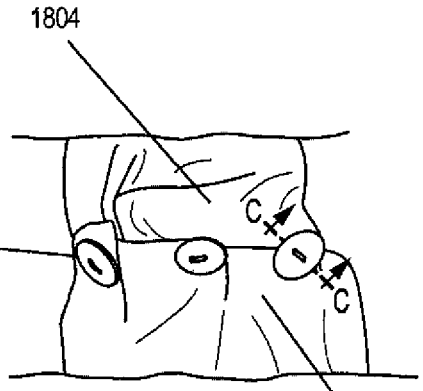
FIG. 18B depict the button-like teething elements of FIG. 18A according to embodiments.
Figure 18C:
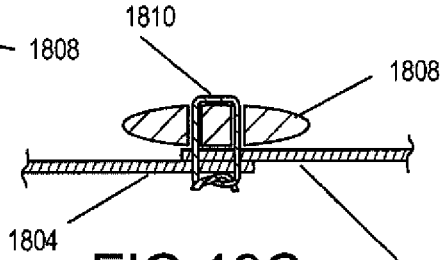
FIG. 18C is a cross-section view of the button-like teething elements of FIG. 18B according to embodiments.

FIG. 18A shows an embodiment of a teething scarf 1800 formed from a fabric sheet 1802 that includes a first end 1804 and a second end 1806. Teething scarf 1800 also includes one or more teething elements 1808 that also function as buttons. These teething elements 1808 may be aligned with each other and spaced apart from one another along the width of the fabric sheet 1802. In other embodiments, the buttons may not be aligned with each other but may be randomly placed at different locations on the fabric sheet 1802 In some embodiments, the buttons (teething elements 1808) may connect opposing ends 1804 and 1806 of the fabric sheet 1802. In other words, the buttons enable conversion of the scarf 1800 back and forth from an infinity scarf to a scarf with free ends. For example, as seen in FIG. 18B, the teething elements 1808 on one or both ends 1804, 1806 may be configured to extend through slots formed on the opposite end 1804, 1806 to secure the two ends 1804, 1806 together. This engagement is best seen in the cross-section of the teething elements 1808 shown in FIG. 18C. Teething element 1808 is secured to first end 1804 using stitching 1810. Each teething element 1808 is then inserted through a slot formed in second end 1806 to secure the two ends 1804, 1806 against one another. Any number of teething element 1808 buttons may be positioned along the fabric sheet 1808. In some embodiments, some or all of the buttons are functional, while in other embodiments at least some of the buttons are merely decorative. Teething elements 1808 may be elliptical or other round shapes or shapes with rounded corners. Teething elements may define two or more holes that are configured to receive stitching 1810. In other embodiments, teething elements 1808 may include one or more shanks that are configured to receive stitching 1810 to secure the teething element 1810 to the fabric sheet 1802.

Figures 19A, 19B:
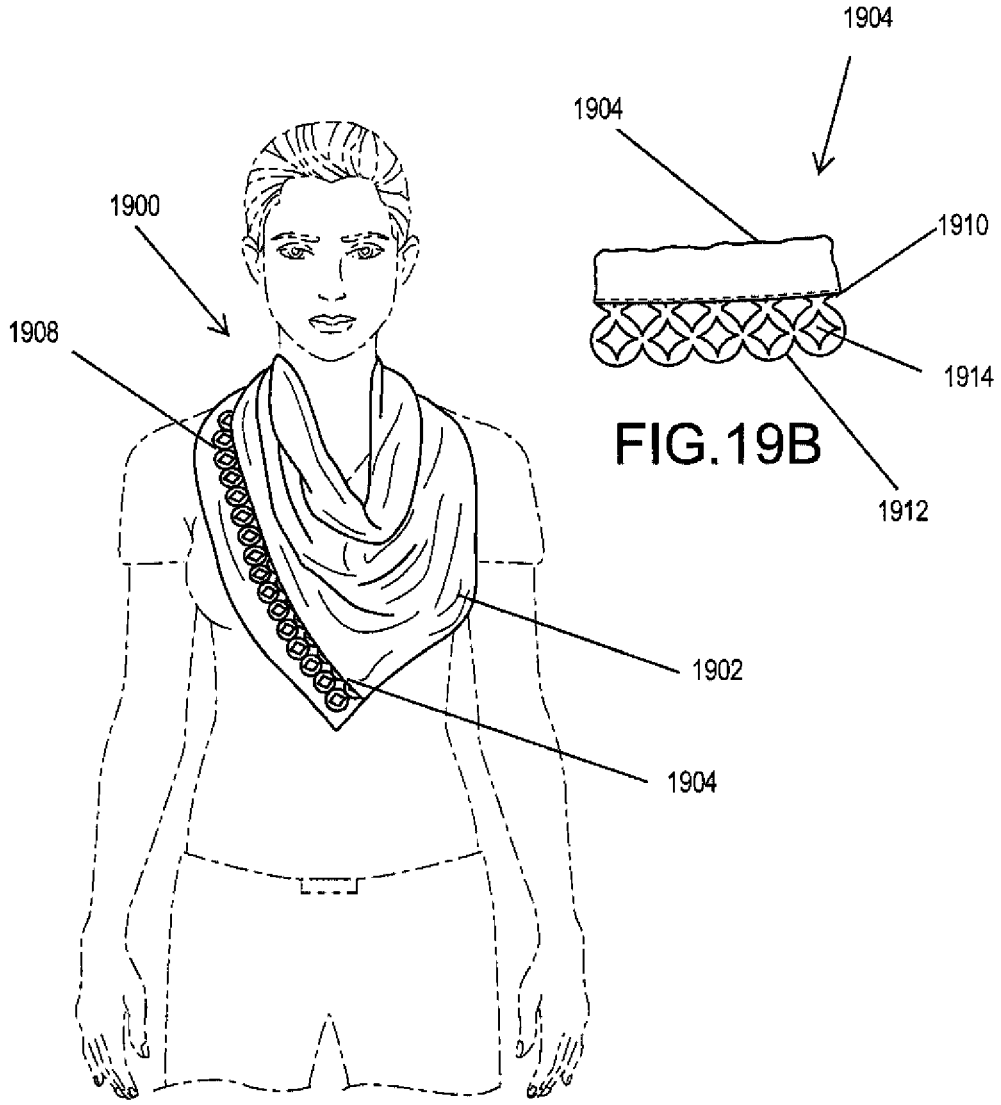
FIG. 19A depicts an embodiment of a teething scarf having a repeating pattern of teething elements according to embodiments.
FIG. 19B depicts the repeating pattern of teething elements of FIG. 19A according to embodiments.

FIG. 19A depicts an embodiment of a teething scarf 1900 that includes a fabric sheet 1902. Fabric sheet 1902 may be formed into a continuous loop, such as like an infinity scarf. Fabric sheet 1902 may include one or more teething members 1908 that may couple with an edge 1904 of the fabric sheet 1902. The teething element 1908 may include a strip 1910 of food grade rubber or plastic that couples to an edge 1904 of the fabric sheet 1902. The teething element 1908 may be a plain piece, or may include multiple apertures to form an aesthetically pleasing or fashionable design. For example, the teething element 1908 may include a number of circular, diamond, and/or square patterns. The teething element 1908 may extend along the entire length or circumference of the fabric sheet 1902, or may only extend along a portion of the fabric sheet 1902. The teething element 1908 may be on an inner edge, outer edge, or both. In some embodiments, the teething element 1908 may be tapered from a first end to a second end to gradually reduce the width of the teething element 1908.

FIG. 19B depicts a portion of the teething element 1908. Here, teething element 1908 includes a number of connected circular tabs 1912 that extend outward from the strip 1910. In some embodiments, the tabs 1912 may be unconnected such that each tab 1912 may move independently of an adjacent tab 1912. Each tab 1912 may include an additional design cut or stamped into it. For example, each tab 1912 may include a diamond shape portion 1914 formed entirely through, stamped, embossed, and/or otherwise formed within the tab 1912. The portion 1914 may define an aperture or may merely be a textured portion. It will be appreciated that the shape and/or size of each tab 1912 and/or portion 1914 may vary along the length of the teething element 1908.

Figures 20A, 20B:
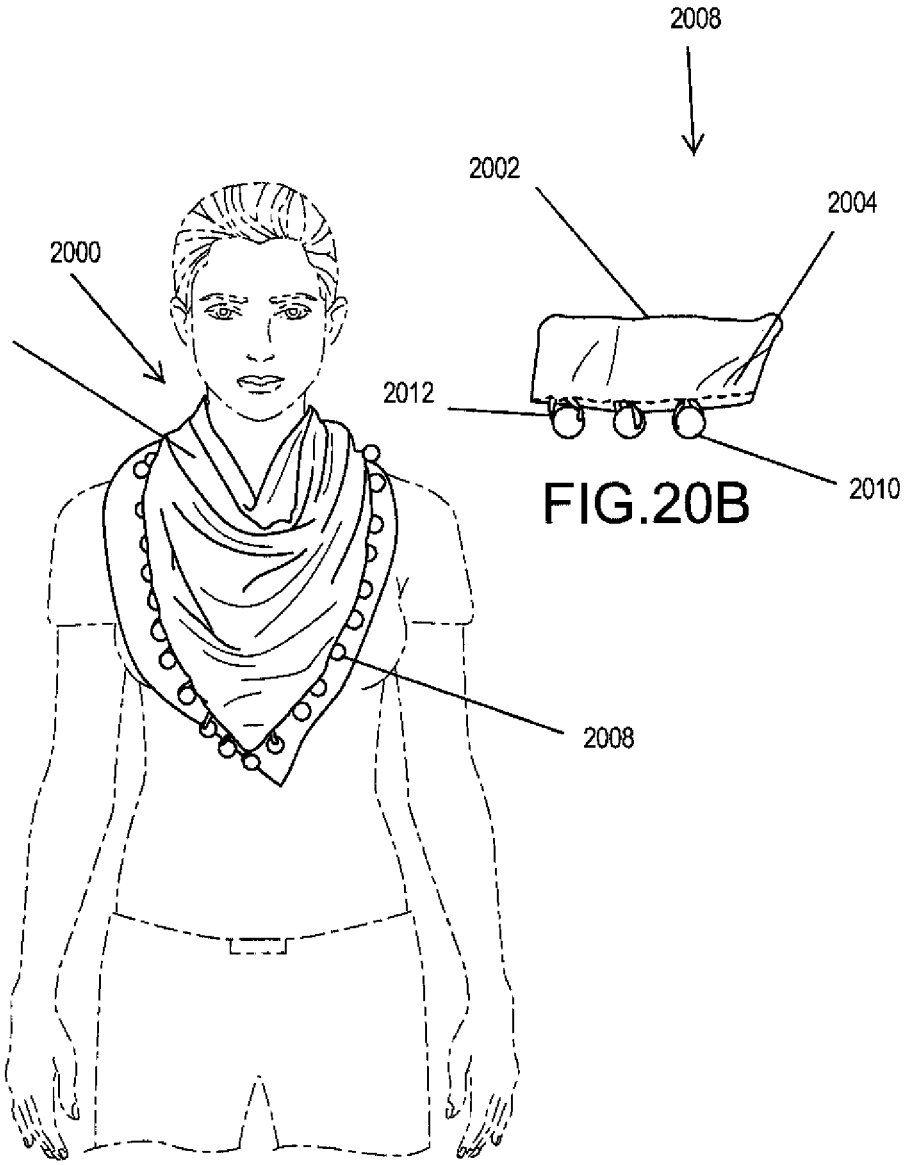
FIG. 20A depicts an embodiment of a teething scarf having an array of teething elements according to embodiments.
FIG. 20B depicts the array of teething elements of FIG. 20A according to embodiments.

FIG. 20A depicts an embodiment of a teething scarf 2000 having a fabric sheet 2002 that is formed into a continuous loop like an infinity scarf. Fabric sheet 2002 may be coupled with at least one teething element 2008. For example, as seen in FIG. 20B, the teething element 2008 includes a plurality of balls 2010 that couple to an edge 2004 of the fabric sheet 2002. These balls 2010 may be uniformly spaced from one another along the edge 2004. In some embodiments, the teething scarf 2000 may include teething element 1708 having shapes other than balls and/or may be irregularly spaced from one another. For example, the teething element 2008 may be square shaped, rectangular shaped, triangular shaped, moon shaped, irregular shaped, etc. As illustrated, the teething element balls 2010 couple to the scarf with strings 2012 that pass through an aperture in the balls 2010. These strings 2012 may be sewn between opposing layers of fabric that form the teething scarf 2000 or otherwise coupled to the fabric. In some embodiments, the balls may be removably coupled to the scarf 2000. As explained above, the teething element 2008 may be both decorative as well as provide the baby something to chew on. Accordingly, the teething element 2008 may only extend over a portion of the scarf 2008 (e.g., front of the teething scarf 2000 when worn, outer edge, inner edge). In some embodiments, the teething element 2008 may extend along an entire perimeter of the scarf 2000.

Figures 21A, 21B:
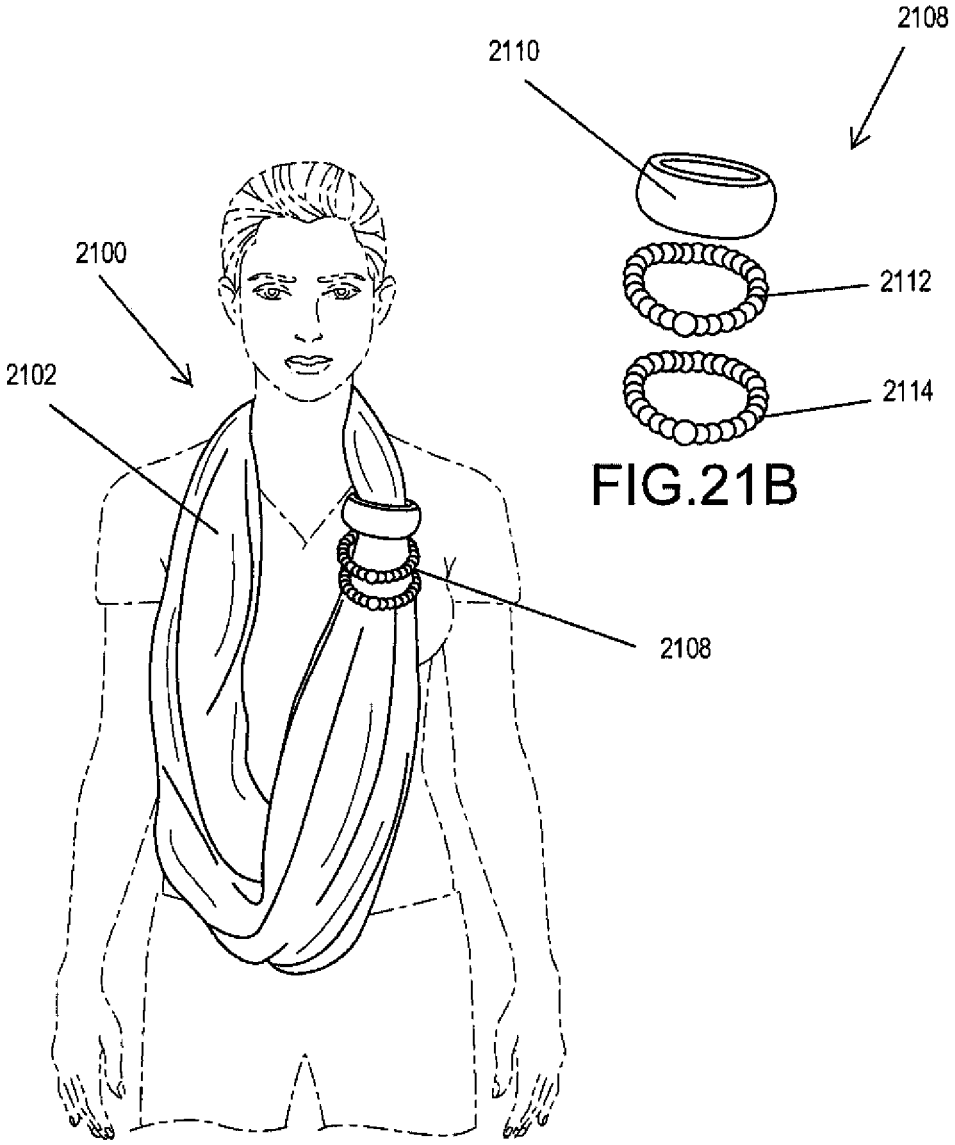
FIG. 21A depicts an embodiment of a teething scarf having multiple ring-like teething elements according to embodiments.
FIG. 21B depicts the multiple ring-like teething elements of FIG. 21A according to embodiments.

FIG. 21A depicts a teething scarf 2100 having a fabric sheet 2102 in the form of a continuous loop. Fabric sheet 2102 may be encircled by multiple teething elements 2108 in the form of rings 2110, 2112, 2114. Because the fabric sheet 2102 does not have free ends, the rings 2110, 2112, 2114 can be repositioned anywhere along the scarf 2100 or may be secured at a particular position using one or more fasteners and/or stitching. FIG. 21B illustrates three rings 2110, 2112, 2114, although different numbers of rings are possible. By including multiple rings, the teething scarf provides additional objects of interest for babies. The rings may also differ from one another in diameter, shape, thickness, design, etc. to provide aesthetic and fashionable appeal. For example, ring 2110 is a thick smooth-sided ring, while rings 2112 and 2114 are thin textured rings. For example, rings 2112 and 2114 may include a number of ridges that are radially aligned.

Figure 22A:
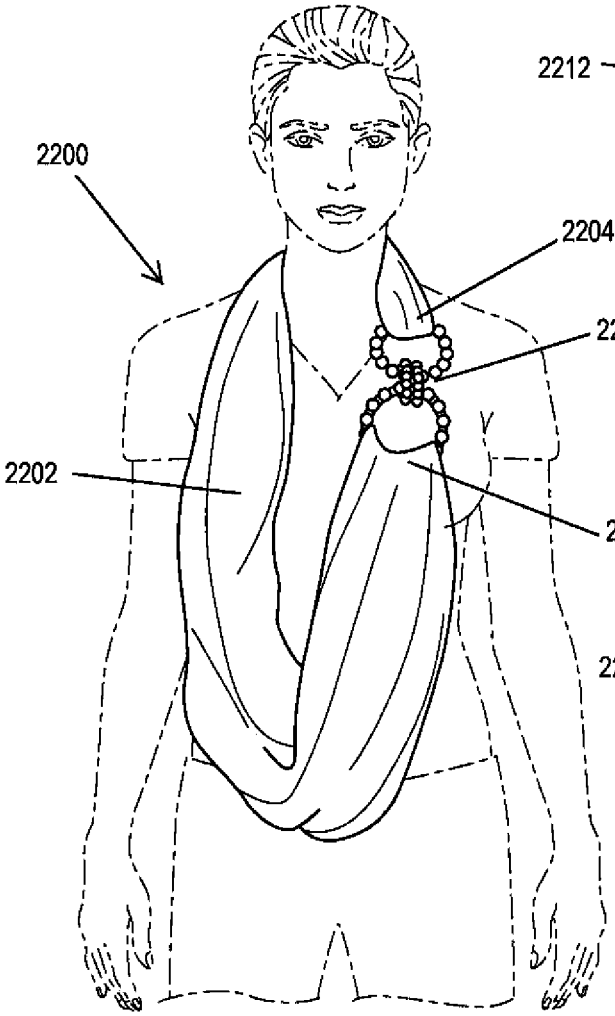
FIG. 22A depicts an embodiment of a teething scarf having multiple interconnected teething elements according to embodiments.
Figure 22B:
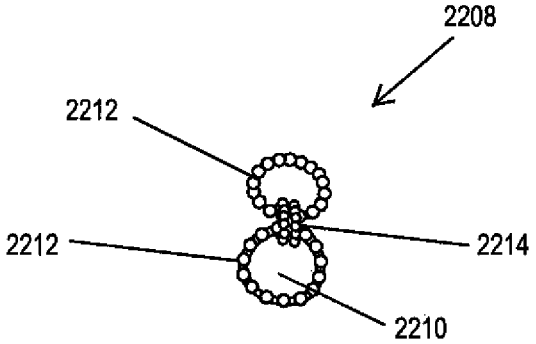
FIG. 22B depicts the multiple interconnected teething elements of FIG. 22A according to embodiments.

FIG. 22A depicts a teething scarf 2200 that is formed from a fabric sheet 2202 that has a first end 2204 and a second end 2206. The first end 2204 and the second end 2206 are joined together using a number of teething elements 2208 to form a continuous loop, such as an infinity scarf. Fabric sheet 2202 may be similar to those described elsewhere herein. The first end 2204 of the fabric sheet 2202 may be coupled to a first one of the teething elements 2208 and the second end 2206 may be coupled to a second one of the teething elements 2208. The two teething elements 2208 may be coupled to one another to complete the continuous loop. As shown in FIG. 22B, teething elements 2208 include multiple annular elements that are interlinked. For example, teething elements 2208 include two large annular members 2212 that each define central openings 2210. Each of the large annular members 2212 may be beaded and/or have a number of bulbs spaced around an outer periphery of the annular member 2212. The central openings 2210 may be configured to receive either the first end 2204 or the second end 2206 of the fabric sheet 2202. The central openings 2210 may also be configured to receive one or more smaller annular members 2214. Here, teething scarf 2200 includes two smaller annular members 2214 that are also beaded (although other textures, including smooth, may be used). Each of the smaller annular members 2214 may define a central opening (not shown) that is configured to receive a portion of each of the larger annular members 2212. This allows the smaller annular members 2214 to link the larger annular members 2212 (and thus the first end 2204 and the second end 2206 of the fabric sheet 2202) together to form the continuous loop of teething scarf 2200. While shown here having annular teething elements, it will be appreciated that other shapes and numbers of teething elements may be used in similar arrangements. In the arrangement shown in FIG. 24A, the smaller annular members 2214 may be positioned side by side between the two ends 2204, 2206 of the fabric sheet 2202 such that the smaller annular members 2214 are in generally concentric alignment with one another.

Figure 22C:
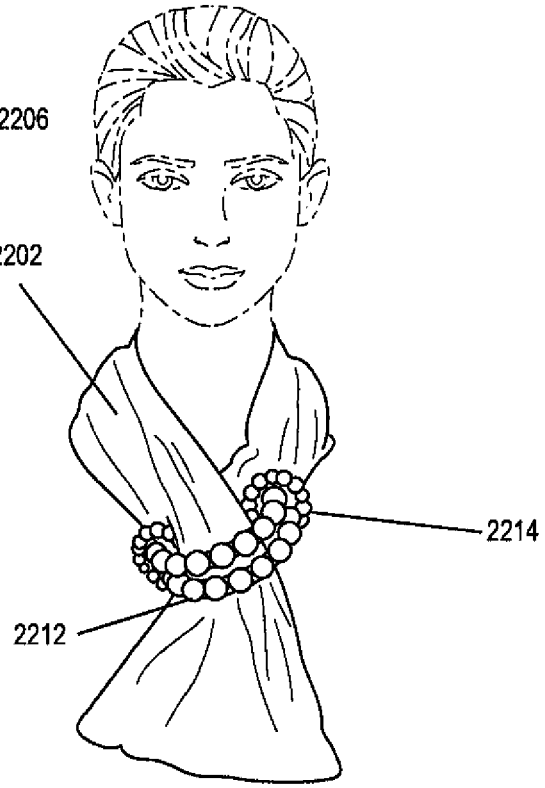
FIG. 22C depicts an alternative technique of wearing the teething scarf of FIG. 22A according to embodiments.

While depicted in FIG. 22A as being draped around a wearer's neck with the neck being inserted into a center of the continuous loop, it will be appreciated that teething scarf 2200 may be worn in other ways. For example, FIG. 22C shows teething scarf 2200 being worn in an alternative style. Here, the large annular members 2212 may be rotated such that the large annular members 2212 are in generally concentric alignment with one another, thereby causing the first end 2204 and the second end 2206 to come in close proximity with one another, in some cases even coming into contact with one another. To hold the large annular members 2212 in this position, the smaller annular members 2214 may be repositioned such that they are on opposing sides of the large annular members 2212 and/or at least partially spaced apart from one another around the outer periphery of the larger annular members 2212. In some embodiments, a central opening of the smaller annular members 2214 may be sized to be slightly larger than the combined thicknesses of the larger annular members 2212 such that the smaller annular members 2214 may constrain movement of the larger annular members 2212. In some embodiments, greater numbers of smaller annular members 2214 may be used, with these members spaced at regular and/or irregular intervals around the outer periphery of the larger annular members 2212. In such a manner, the teething scarf 2200 may be held in place while being folded across itself.

Figures 23A, 23B:
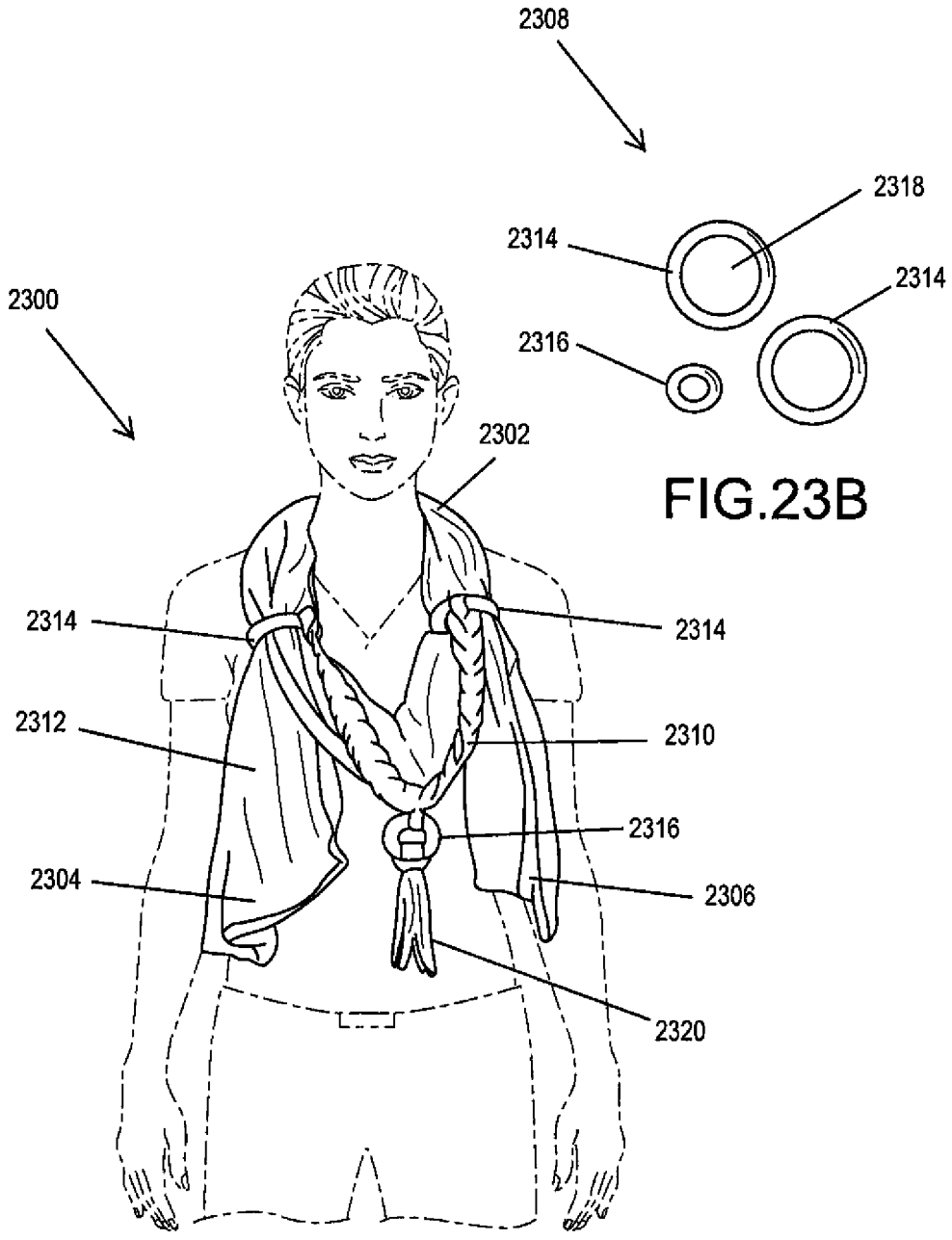
FIG. 23A depicts an embodiment of a teething scarf having multiple ring-like teething elements according to embodiments.
FIG. 23B depicts the multiple ring-like teething elements of FIG. 23A according to embodiments.

FIG. 23A depicts an embodiment of a teething scarf 2300 that includes a fabric sheet 2302 having a first and second free end 2304, 2306. The free ends 2304, 2306 enable a user to wrap the teething scarf 2300 around their neck in any number of arrangements. Fabric sheet 2302 includes a braided portion 2310 and an unbraided portion 2312. As shown here, braided portion 2310 extends along an edge of a medial portion of the fabric sheet 2302, with the rest of fabric sheet 2302 making up the unbraided portion 2312. It is understood that some embodiments may have multiple braids which may be similar and/or may differ from each other not only in color but also in length, size of braids, location on the fabric sheet 2302, etc. The braided portion 2310 is coupled to at least one teething element 2308. In some embodiments, the teething elements 2308 may all couple to one of the braided portion 2310 and/or multiple braided portions 2310 are included that each may include zero or more teething elements 2308. Here, braided portion is coupled with three teething elements 2308 (although other numbers may be contemplated). As shown in FIG. 23B, the teething element 2308 may include a number of annular members. For example, the teething element 2308 may include two larger annular members 2314 and a smaller annular member 2316. As shown in FIG. 23A, the smaller annular member 2316 is secured to a medial section of the braided portion 2310, with the larger annular members 2314 spaced apart on either side of the smaller annular member 2316. In some embodiments, a user may wrap the fabric sheet 2302 to form a continuous loop, with each free end 2304, 2306 being inserted within a central opening 2318 of the larger annular member 2314 on the opposing side of the fabric sheet 2302. The free ends 2304, 2306 may be pulled completely through the larger annular members 2314 such that the free ends 2304, 2306 drape downward from the larger annular members 2314, while a portion of the fabric sheet 2302 forms a continuous loop between the larger annular members 2314 as depicted in FIG. 23A. In such a configuration, the smaller annular member 2316 may be positioned at a bottom of the continuous loop between the free ends 2304, 2306. In some embodiments, the smaller annular member 2316 may include an additional aesthetic feature, such as a tassel 2320, which may dangle downward from the smaller annular member 2316. While described using annularly-shaped teething elements 2308, it will be appreciated that other shapes of teething elements may be used. For example, any shape of teething element that includes an opening or other feature that can grab and retain a portion of the fabric sheet 2302 to allow the teething scarf 2300 to be worn as shown in FIG. 23A may be used.

Figure 24A:
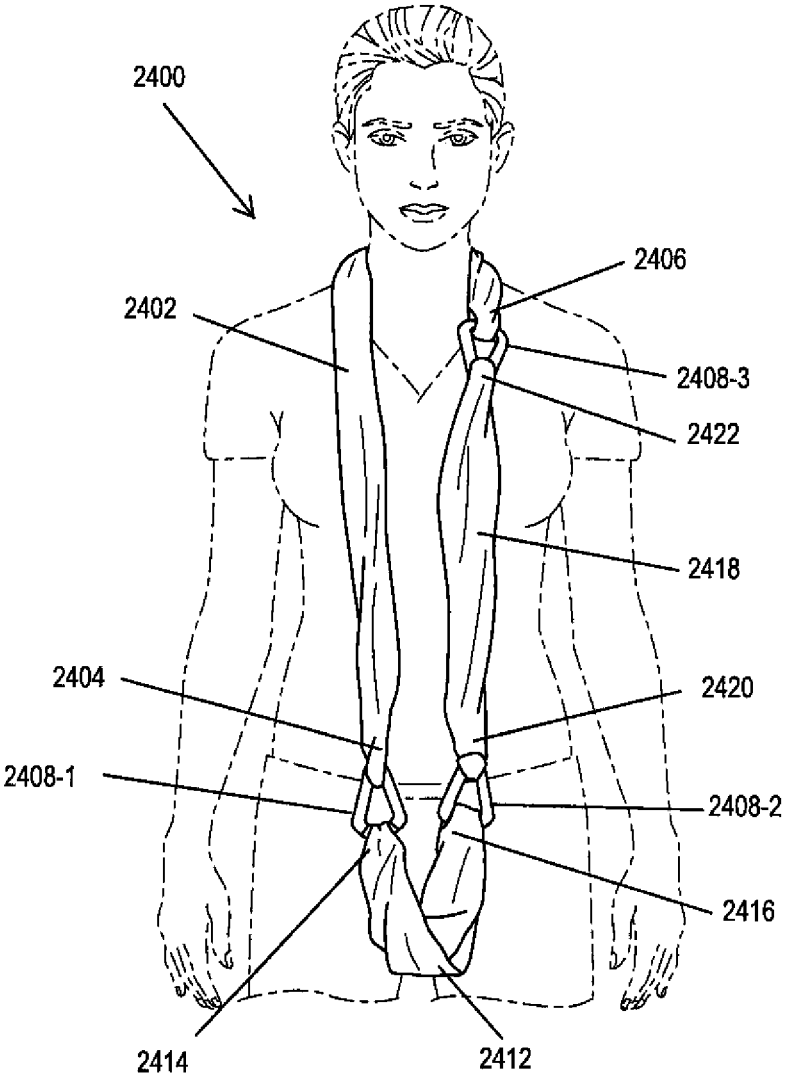
FIG. 24A depicts an embodiment of a teething scarf having multiple teething elements according to embodiments.

FIG. 24A shows an embodiment of a teething scarf 2400 that includes both multiple teething elements 2408 and multiple fabric sheets 2402, 2412, and 2418. As illustrated, a pair of teething elements 2408 join each of the fabric sheets 2402, 2412, 2418 to another one of the fabric sheets 2402, 2412, 2418 to form a ring-like teething scarf 2400. For example, a first fabric sheet 2402 is coupled with a second fabric sheet 2412 using a first teething element 2408-1, the second fabric sheet 2412 is coupled with a third fabric sheet 2418 using a second teething element 2408-2, and the third fabric sheet 2418 is coupled with the first fabric sheet 2402 using a third teething element 2408-3. The ends 2404 and 2406 of the first fabric sheet 2402 may couple to a top or bottom of each teething element 2408-1, 2408-3, such as by wrapping around a portion of the teething element 2408-1, 2408-3 such that each end 2404, 2406 may be coupled to itself (e.g., be sewn). Similarly, ends 2414 and 2416 of the second fabric sheet 2412 may couple to an opposite side of each teething element 2408-1, 2408-2 and ends 2420 and 2422 of the third fabric sheet 2418 may be coupled to an opposite side of each teething element 2408-2, 2408-3. This allows the three fabric sheets 2402, 2412, and 2418 to be coupled end to end (in daisy-chained fashion) in the form of a continuous loop, with the teething elements 2408 serving as linkages that connect the fabric sheets 2402, 2412, and 2418. While shown here with three teething elements 2408 and three fabric sheets 2402, 2412, and 2418 it will be appreciated that other combinations of numbers of fabric sheets and teething elements may be used. In some embodiments, teething scarf 2400 may be worn by being draped around a wearer's neck with the neck within the center opening of the continuous loop. Additionally, some or all of the fabric sheets and/or teething elements may be different sizes and/or shapes from one another.

Figure 24B:
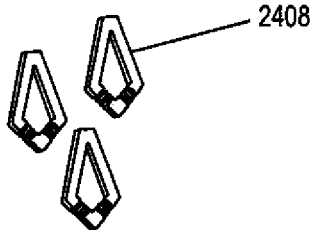
FIG. 24B depicts the multiple teething elements of FIG. 24A according to embodiments.
Figure 24C:
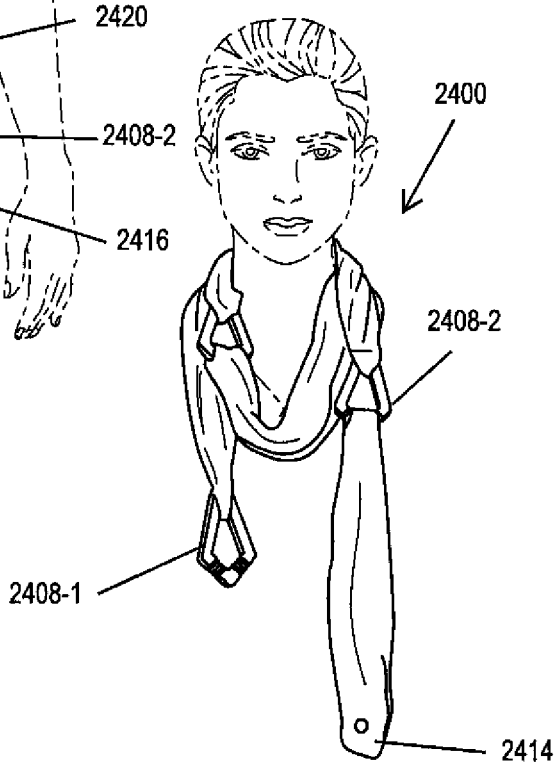
FIG. 24C depicts an alternative technique of wearing the teething scarf of FIG. 24A according to embodiments.

As seen in FIG. 24B, each teething element 2408 has an irregular pentagonal shape and defines a central opening 2410. For example, each teething element 2408 includes two long sides that, on one end, connect at a point forming the fifth side, and on an opposite end are each coupled with a shorter third or fourth sides that angle inward to connect to one another. The outer periphery of the central opening 2410 may or may not have a shape corresponding to the shape of the outer periphery of the teething element 2408. In some embodiments, one or more of the teething elements 2408 and/or the ends of fabric sheets 2402, 2412, 2418 may include a mechanism that allows one or more of the teething elements 2408 to be detached from one or more ends of the fabric sheets 2402, 2412, 2418. For example, one or more of the teething elements 2408 may have a snap or other coupling mechanism that, when engaged, provides a continuous teething element and that, when disengages, interrupts the outer periphery of the teething element 2408 and provides access to the central opening 2410 such that the teething element 2408 may be slid out from its coupling with the respective fabric sheet(s). In some embodiments, one or more of the fabric sheets may include a release mechanism, such as a button or snap, that allows an end of the fabric sheet to be removably coupled with a more medial portion of the fabric sheet. Thus, when engaged, the end of the fabric sheet forms a loop that may securely receive a portion of the teething element 2408, such as by inserting the end of the fabric sheet through a central opening 2410 of the teething element 2408, wrapping the end over one side of the teething element 2408, and buttoning, snapping, and/or otherwise securing the end of the fabric sheet to the more medial portion of the fabric sheet. When the end of the fabric sheet is disengaged, the teething element 2408 may be removed from the end of the fabric sheet. This allows for the teething scarf 2400 to be worn in different styles. For example, as shown in FIG. 24C, the teething scarf 2400 is wrapped around the wearer's neck multiple times, with ends of two different fabric sheets dangling below a loop of fabric, with one of the ends including a teething element 2408 that has been disengaged from another of the ends. It will be appreciated that the arrangements of teething scarf 2400 are numerous, with any number of combinations possible based on the removal of teething elements from one or more ends of the fabric sheets, removal from and/or addition of fabric sheet(s) and/or teething element(s) to the teething scarf 2400, number of loops around a wearer's neck, and the like.

It will be appreciated that the annularly shaped teething members described above may be coupled with their respective fabric sheets in different ways. As just one example, the fabric sheet may be received within a central aperture defined by an annular teething element. This may allow a position of the teething element to be adjusted by sliding the teething element along a length of the fabric sheet. In other embodiments, the teething element may be secured to a particular location on the fabric sheet, such as by using stitching. It will also be appreciated that other types of teething elements may be used in similar embodiments to connect ends of multiple fabric sheets together. Additionally, fabric sheets 2402, 2412, 2418 may have the same dimensions or may have at least some differences in dimensions. While shown with teething elements 2408 are shown to be identical, it will be appreciated that different teething elements may be used on either side of the scarf 2400.

Figure 25A:
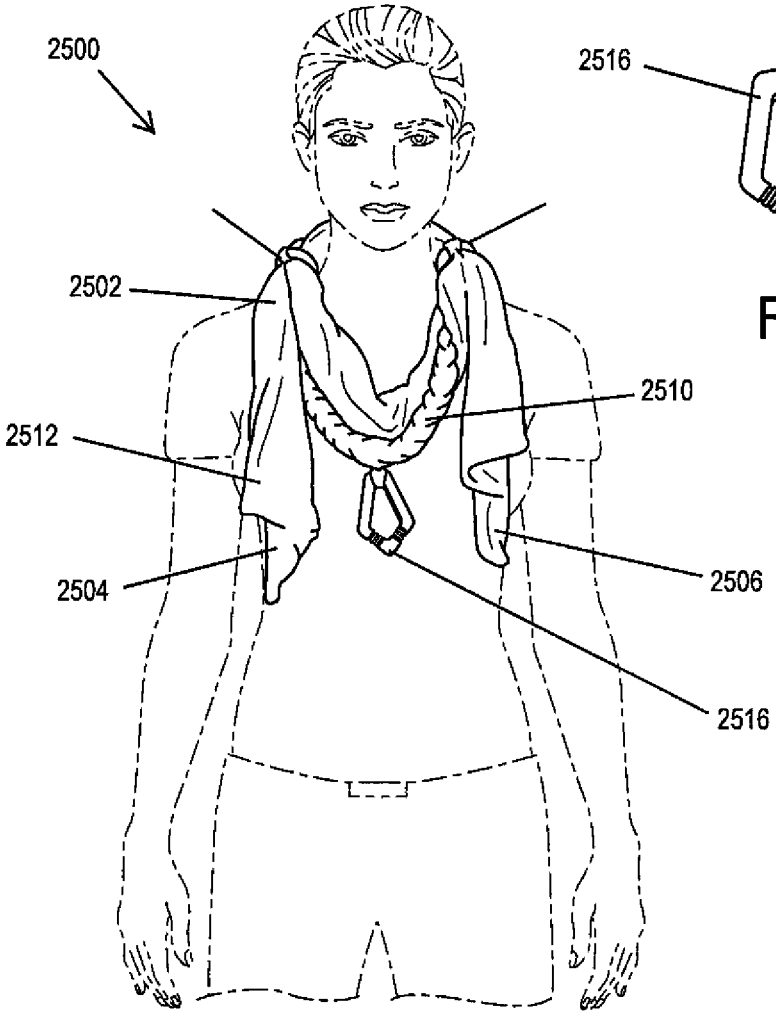
FIG. 25A depicts an embodiment of a teething scarf having multiple teething elements according to embodiments.
Figure 25B:
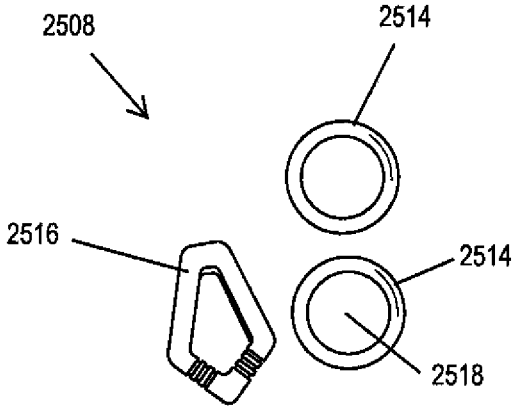
FIG. 25B depicts the multiple teething elements of FIG. 25A according to embodiments.

FIG. 25A depicts an embodiment of a teething scarf 2500, similar to teething scarf 2300, that includes a fabric sheet 2502 having a first and second free end 2504, 2506. The free ends 2504, 2506 enable a user to wrap the teething scarf 2500 around their neck in any number of arrangements. Fabric sheet 2502 includes a braided portion 2510 and an unbraided portion 2512. As shown here, braided portion 2510 extends along an edge of a medial portion of the fabric sheet 2502, with the rest of fabric sheet 2502 making up the unbraided portion 2512. It is understood that some embodiments may have multiple braids which may be similar and/or may differ from each other not only in color but also in length, size of braids, location on the fabric sheet 2502, etc. The braided portion 2510 is coupled to at least one teething element 2508. In some embodiments, the teething elements 2508 may all couple to one of the braided portion 2510 and/or multiple braided portions 2510 are included that each may include zero or more teething elements 2510. Here, braided portion is coupled with three teething elements 2508 (although other numbers may be contemplated). As shown in FIG. 25B, the teething element 2508 may include a number of annular and/or other shaped members. For example, the teething element 2508 may include two annular members 2514 and an irregularly-shaped pentagonal member 2516 (similar to those described in FIG. 24B. As shown in FIG. 25A, the irregular pentagonal member 2516 is secured to a medial section of the braided portion 2510, with the annular members 2514 spaced apart on either side of the pentagonal member 2516. In some embodiments, a user may wrap the fabric sheet 2502 to form a continuous loop, with each free end 2504, 2506 being inserted within a central opening 2518 of the annular member 2514 on the opposing side of the fabric sheet 2502. The free ends 2504, 2506 may be pulled completely through the annular members 2514 such that the free ends 2504, 2506 drape downward from the annular members 2514, while a portion of the fabric sheet 2502 forms a continuous loop between the annular members 2514 as depicted in FIG. 25A. In such a configuration, the pentagonal member 2516 may be positioned at a bottom of the continuous loop between the free ends 2504, 2506. While described using a combination of annular and pentagonal-shaped teething elements 2408, it will be appreciated that other shapes of teething elements may be used. For example, any shape of teething element that includes an opening or other feature that can grab and retain a portion of the fabric sheet 2502 to allow the teething scarf 2500 to be worn as shown in FIG. 25A may be used.

Figure 25C:
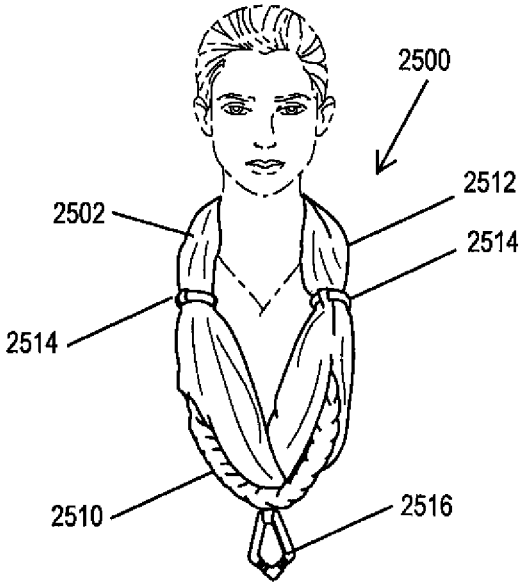
FIG. 25C depicts an alternative technique of wearing the teething scarf of FIG. 25A according to embodiments.
Figure 25D:
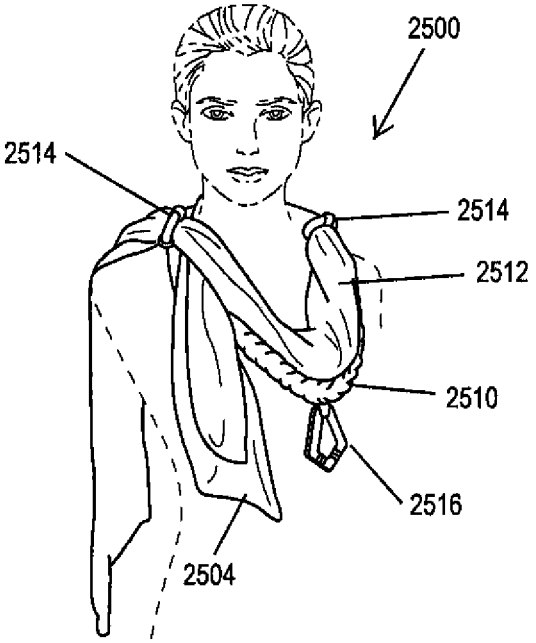
FIG. 25D depicts an alternative technique of wearing the teething scarf of FIG. 25A according to embodiments.
Figure 25E:
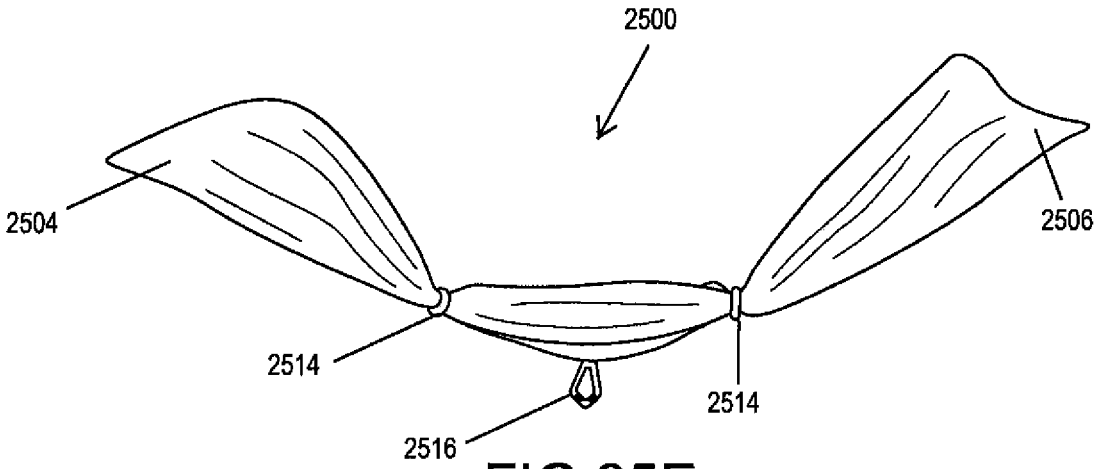
FIG. 25E depicts the teething scarf of FIG. 25A without a user according to embodiments.

Teething scarf 2500 may be worn in a variety of configurations. For example, FIG. 25C depicts teething scarf 2500 being worn as one continuous loop, without any dangling loose ends 2504, 2506. To wear teething scarf 2500 in this manner, the wearer may pull the ends 2504, 2506 through the opposing teething elements 2508 as done in FIG. 25A, except the ends 2504, 2506 may be pulled through the teething elements 2508 from a rear of the teething scarf 2500 such that ends 2504, 2506 are hidden behind a portion of the teething scarf 2500 on which the annular members 2514 are secured. Additionally, the ends 2504, 2506 may be pulled through the annular members 2514 a lesser distance as in FIG. 25A, thereby allowing the ends 2504, 2506 to remain hidden. FIG. 25D shows teething scarf 2500 being worn with one of the ends 2504, 2506 draped down a side of the user's chest. Here, the pentagonal member 2516 is moved toward an opposite side of the chest as the draped end 2504 or 2506, with the annular members 2514 positioned generally atop the wearer's shoulders. Such a configuration may be achieved by pulling one of the ends 2504, 2506 further through one of the annular members 2514 such that one of the ends extends beyond a continuous loop portion of the teething scarf 2500 while the other end 2504, 2506 remains hidden behind the continuous loop. It will be appreciated that teething scarf 2500 may be positioned in a number of configurations not shown herein. FIG. 25E depicts teething scarf 2500 being laid out lengthwise. Here it is seen that annular members 2514 are spaced equidistant from the pentagonal member 2516, which is centered on the teething scarf 2500. It will be appreciated that other spacings and arrangements of the various teething elements may be used.

It will be appreciated that the features of the teething scarves described above may be interchanged in any number of combinations. It will also be appreciated that additional features may be included in any of the teething scarves described herein. For example, the teething scarves may include one or more pockets that provide storage for objects such as pacifiers, additional teething elements, and the like.

Figure 26:
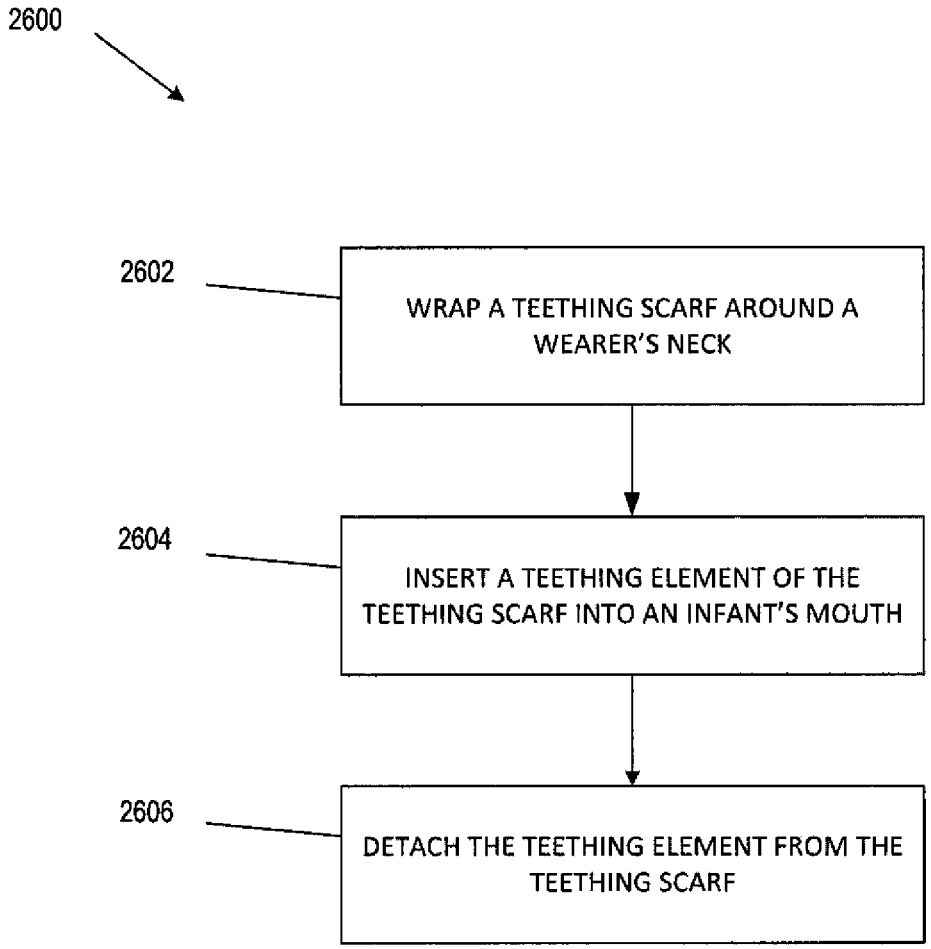
FIG. 26 is a flowchart depicting a process of using a teething scarf according to embodiments.

FIG. 26 is a flowchart depicting a process 2600 of using a teething scarf. Process 2600 may be performed using any of the teething scarves described herein. Process 2600 may begin at block 2602 by wrapping the teething scarf around a wearer's neck at least once such that the wearer's neck is positioned within a continuous loop formed by the teething scarf. In some embodiments, the teething scarf may not form a continuous loop, but the wearer may still position the scarf around their neck. The wearer may drape the scarf around their neck a single time such that the scarf hangs loosely from the neck or the wearer may wrap the scarf around the neck multiple times for a more snug fit. The teething scarf may include a teething element that is formed from a non-toxic material may be configured for use in easing pain associated with teething in infants. The teething element may be positioned proximate the wearer's shoulder when the teething scarf is wrapped around the wearer's neck. In some embodiments, this may be done by sliding or otherwise adjusting the teething element relative to the fabric sheet, while in other embodiments a position of the teething element may be fixed relative to the fabric sheet. In such embodiments, the scarf may be worn in a manner that puts the teething element in a proper position.

At block 2604, the teething element may be inserted into an infant's mouth while the teething scarf is wrapped around the wearer's neck. The infant may then chew on the teething element to relieve pain associated with teething. In some embodiments, process 2600 further includes detaching the teething element from the fabric sheet at block 2606. This allows the teething element to be washed or chilled separately from the rest of the teething scarf. In some embodiments, detaching the teething element may include disengaging a fastener of the at least one fabric sheet to release the teething element. In other embodiments, detaching the teething element may be done by disengaging a securement mechanism of the teething element from the at least one fabric sheet.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A teething scarf, comprising:

a fabric sheet having a length, a width, and a thickness, the width being greater than the thickness, the fabric sheet comprising a first end and a second end; and a teething element coupled with the first end and the second end of the fabric sheet to form a continuous loop along the length of the fabric sheet, the teething element comprising a non-toxic material and being configured for use in easing pain associated with teething in infants, wherein:

the first end of the fabric sheet forms a first closed loop that receives and secures a first portion of the teething element therein and the second end of the fabric sheet forms a second closed loop that receives and secures a second portion of the teething element therein;

the first closed loop is formed by a first tip of the fabric sheet being secured to a first medial portion of the fabric sheet using one or both of stitching or a fastener;

the second closed loop is formed by a second tip of the fabric sheet being secured to a second medial portion of the fabric sheet using one or both of stitching or a fastener; and a position of each of the first closed loop and the second closed loop is fixed.

2. The teething scarf of claim 1, wherein:

the teething element comprises an annular member that is coupled with the first end and the second end of the fabric sheet.

3. The teething scarf of claim 1, wherein:

the teething element is detachably coupled with the fabric sheet.

4. The teething scarf of claim 1, wherein:

the teething element comprises a generally s-shaped member having a first end and a second end.

5. The teething scarf of claim 4, wherein: the first end of the fabric sheet is coupled with the first end of the generally s-shaped member and the second end of the fabric sheet is coupled with the second end of the generally s-shaped member.

6. The teething scarf of claim 1, wherein: the teething element comprises an annular member that includes a plurality of bulbous sections spaced apart along a circumference of the annular member.

7. The teething scarf of claim 1, wherein:

the teething element comprises at least two interconnected members.

8. The teething scarf of claim 7, wherein:

the at least two interconnected members comprise a first interconnected member and a second interconnecting member; and the first end of the fabric sheet is coupled with the first interconnected member and the second end of the fabric sheet is coupled with the second interconnected member.

9. The teething scarf of claim 7, wherein:

the at least two interconnected members comprise two small annular members that each define central openings that receive a portion of two large annular members, thereby linking the two large annular members to one another.

10. The teething scarf of claim 9 wherein:

the two small annular members are movable between a first position in which the two small annular members are side by side and generally coaxial with one another and a second position in which the two small annular members are on opposing sides of the two large annular members.

11. The teething scarf of claim 10 wherein: when in the first position, the two small annular members permit rotational movement of the two large annular members along an axis generally aligned with a center of the two small annular members; and when in the second position, the two small annular members lock the two large annular members in a position in which the two large annular members are side by side and generally coaxial with one another.

12. The teething scarf claim 1, wherein:

the fabric sheet is constructed of multiple pieces of fabric.

13. The teething scarf of claim 1 wherein:

one or both of the fabric sheet or the teething element comprises a releasable coupling mechanism that is usable to repeatedly couple and decouple the teething element with the fabric sheet.

14. A teething scarf, comprising:

a fabric sheet having a length, a width, and a thickness, the width being greater than the thickness, the fabric sheet comprising a first end and a second end; and a teething element coupled with the first end and the second end of the fabric sheet to form a continuous loop along the length of the fabric sheet, the teething element comprising a non-toxic material and being configured for use in easing pain associated with teething in infants, wherein:

the teething element comprises at least two interconnected members that are directly coupled with one another such that a portion of a first of the at least two interconnected members extends through an interior of a second of the at least two interconnected members;

the at least two interconnected members comprise a first interconnected member and a second interconnecting member; and the first end of the fabric sheet is coupled with the first interconnected member and the second end of the fabric sheet is coupled with the second interconnected member.

15. The teething scarf of claim 14, wherein:

one or both of the fabric sheet or the teething element comprises a releasable coupling mechanism that is usable to repeatedly couple and decouple the teething element with the fabric sheet.

* * * * *